US006533478B1

(12) United States Patent
Matsuyama

(10) Patent No.: US 6,533,478 B1
(45) Date of Patent: Mar. 18, 2003

(54) IMAGE FORMING APPARATUS

(75) Inventor: Shinichi Matsuyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 09/604,095

(22) Filed: Jun. 27, 2000

(30) Foreign Application Priority Data

Jun. 29, 1999 (JP) ..... 11-184263
Jun. 22, 2000 (JP) ..... 2000-188401

(51) Int. Cl.[7] ..... B41J 11/42

(52) U.S. Cl. ..... 400/582; 400/605; 271/3.15; 399/320

(58) Field of Search ..... 400/582, 613, 400/621, 701, 702, 605; 347/101, 153, 155, 212, 202, 203; 271/288, 289, 290, 3.15, 279; 399/320, 328, 339

(56) References Cited

U.S. PATENT DOCUMENTS 4,652,110 A * 3/1987 Sato et al. ..... 355/3
4,780,742 A * 10/1988 Takahashi et al. ..... 355/3
4,941,377 A * 7/1990 Ishihara et al. ..... 83/211
5,323,176 A * 6/1994 Sugiura et al. ..... 346/25
5,349,376 A * 9/1994 Imaizumi et al. ..... 347/16
5,423,620 A * 6/1995 Tokairin ..... 400/582
5,831,744 A * 11/1998 Kataoka ..... 358/296

FOREIGN PATENT DOCUMENTS

| | | |
|---|---|---|
| JP | 7-237348 | 9/1995 |
| JP | 8-002090 | 1/1996 |
| JP | 10-230589 | 9/1998 |

* cited by examiner

*Primary Examiner*—Andrew H. Hirshfeld
*Assistant Examiner*—Darius N. Cone
(74) *Attorney, Agent, or Firm*—Fitzpatrick, Cella, Harper & Scinto

(57) ABSTRACT

A control unit controls a cut roller and a pinch roller according to a detection output signal representing the type of roll paper, thereby directly delivering a printed paper not requiring protection treatment.

7 Claims, 25 Drawing Sheets

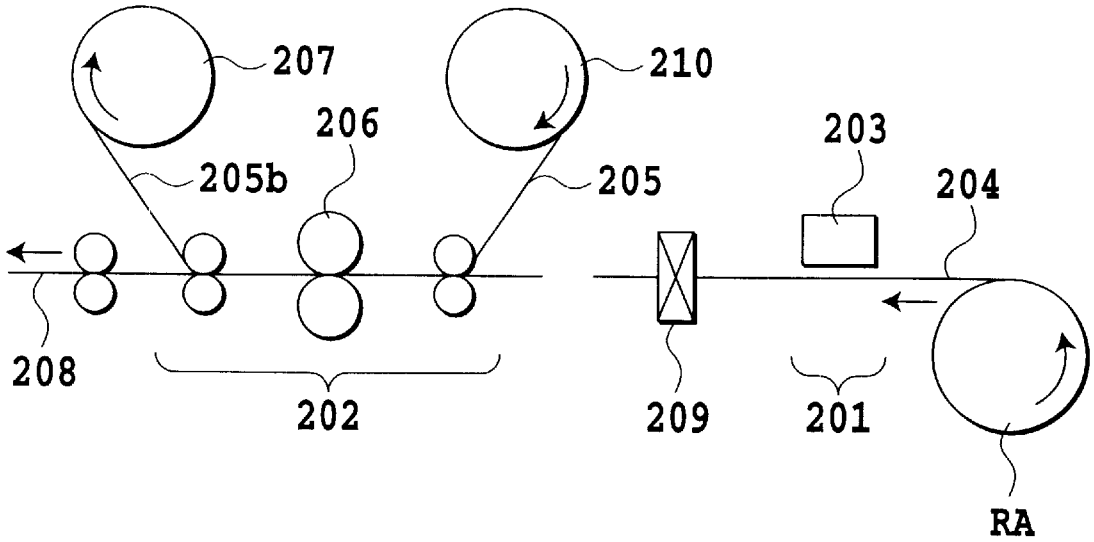
FIG.42
FIG.43A
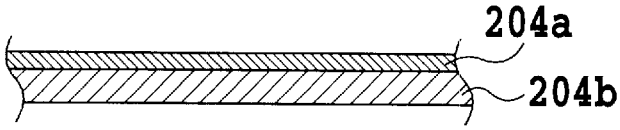
FIG.43B
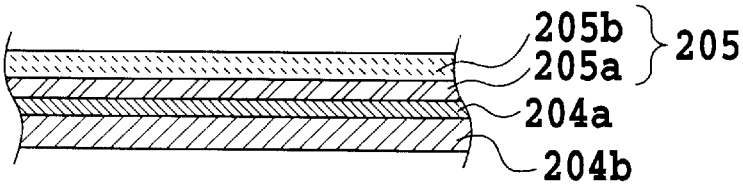
FIG.43C
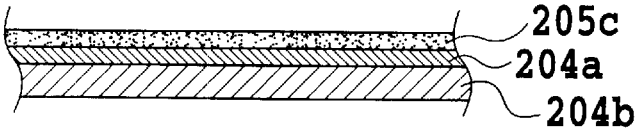

IMAGE FORMING APPARATUS

This application is based on Japanese Patent Application Nos. 11-184263 (1999) filed Jun. 29, 1999, and 2000-188401 (2000) filed Jun. 22, 2000, the contents of which are incorporated hereinto by reference.

BACKGROUND OF THE INVENTION

1. Field of the Invention

The present invention relates to an image forming apparatus which is able to perform predetermined protection treatment to the recording surface of a recorded printing medium.

2. Description of Prior Art

As an image forming apparatus, an ink-jet printing apparatus, for example, is widely used in practical applications. In the ink-jet printing apparatus, one which is known to have a protection treatment apparatus which performs protection treatment to the recording surface of the printing medium for protecting the image recorded by the printing part thereof.

The ink-jet printing apparatus provided with such a heat protection treatment apparatus, for example, as shown in Japanese Patent Application Laid-open No. 10-230589 (1998), comprises a paper feed part provided with a roll paper as a printing medium, a printing part for performing printing operation to the recording surface of the roll paper from the paper feed part, a switchback mechanism for reversing the transportation direction of a paper cut to a predetermined length after printing by the printing part so that it is transportable relative to a protection treatment apparatus disposed right beneath the printing part, a protection treatment apparatus disposed on the lower part of the enclosure of the printing apparatus for heat treating to protect the image formed on the recording surface of the paper, and a delivery part for discharging the paper delivered from the protection treatment apparatus to the outside.

The roll paper in the paper feed part, as shown in, for example, Japanese Patent Application Laid-open No. 7-237348 (1995) and Japanese Patent Application Laid-open No. 7-237348 (1995) and Japanese Patent Application Laid-open No. 8-2090 (1996), as multilayer construction comprised of a protective layer as an ink-permeable porous polymer layer or a porous resin layer which is disposed on the outermost surface layer and an ink absorption retaining layer which is disposed under the protective layer.

When ink adheres to the recording surface of such a roll paper, the ink penetrates the protective layer and reaches the ink absorption retaining layer. After that, when the printed recording surface is heat treated by the protection treatment apparatus under an applied pressure, by the heat treatment, the protective layer is changed to a flat transparent film, thereby protecting the image. Namely by this processing, the protective layer protects the ink absorption retaining layer to improve the water resistance and weather resistance of the roll paper. At this moment, moisture of the ink absorbed into the roll paper evaporates.

In an ink-jet printing apparatus provided with the above-described protection treatment apparatus, it is desirable that a roll paper having no protective layer and cut sheets, and the like are also printed as well in the same apparatus.

However, when, after the roll paper having no protective layer is printed, the printed paper is passed through the protection treatment apparatus and discharged, depending on the property differences of the paper, there may occur malfunctions such as sticking of paper in the protection treatment apparatus, jamming of the paper, or damage of the paper due to heat in the protection treatment apparatus.

SUMMARY OF THE INVENTION

In view of the above problems, an object of the present invention is to provide an image forming apparatus capable of performing protection treatment to the recording surface of a recorded printing medium, which is able to selectively perform recording operation to a printing medium not requiring protection treatment or a printing medium requiring protection treatment, and avoid occurrence of abnormal transportation and damages due to heat of printing medium not requiring protection treatment.

In accordance with the present invention which attains the above object, there is provided an image forming apparatus comprising a common transportation passage through which each of printing media of a plurality of types is transported, a printing part disposed opposite to the common transportation passage for performing printing operation to the recording surf ace of the printing medium, a protection treatment transportation passage connected to the common transportation passage and provided with a protection treatment apparatus for performing protection treatment to the printing medium for treating an image on the recording surface printed by the printing part, a discharge transportation passage connected to the common transportation passage for discharging the printing medium printed by the printing part, a selective delivery part for delivering the printing medium printed by the printing part from the common transportation passage selectively to the protection treatment transportation passage or the discharge transportation passage, a printing medium detection part for detecting the type of the printing medium, and a control part for performing delivery operation of the recorded printing medium to the selective delivery part according to a detection output signal from the printing medium detection part and to the protection treatment transportation passage or discharge transportation passage according to the type of the printing medium.

As can be seen from the above description, with the image forming apparatus according to the present invention, the control part performs selective delivery operation of the printing medium from the common transportation passage which is printed by the printing part to the selective delivery part for selectively delivering it to the protection treatment transportation passage or the discharge passage, and to the protection treatment transportation passage or the discharge passage according to the type of the printing medium, so that selective recording operation can be performed to a printing medium not requiring protection treatment or a printing medium requiring protection treatment, and abnormal transportation in the printing medium not requiring protection treatment and damages due to heat can be avoided.

The above and other objects, effects, features and advantages of the present invention will become more apparent from the following description of embodiments thereof taken in conjunction with the accompanying drawings.

BRIEF DESCRIPTION OF THE DRAWINGS

FIG. 42 is a diagram schematically showing the entire construction of a third embodiment of the image forming apparatus according to the present invention; and FIGS. 43A, 43B and 43C are partial sectional diagrams respectively showing the structure of the printing medium and protective laminate member used in the third embodiment shown in FIG. 42.

DESCRIPTION OF PREFERRED EMBODIMENTS

[First Embodiment]

Figure 2:
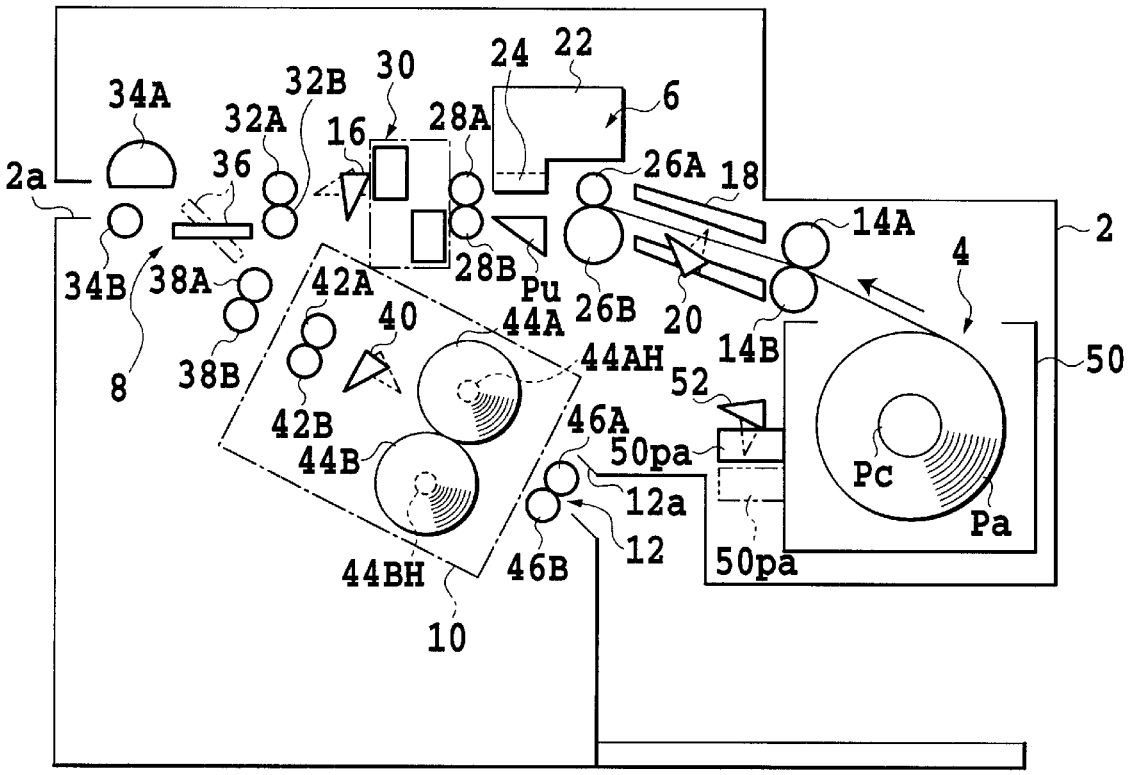
FIG. 2 is a schematic diagram showing the entire construction of the first embodiment of the image forming apparatus according to the present invention.

FIG. 2 schematically illustrates the first embodiment of the image forming apparatus according to the present invention. In FIG. 2, the ink-jet printing apparatus comprises, for example, a paper feed part 4 provided with a roll paper Pa as a printing medium, a printing part 6 for performing printing operation to a recording surface of the roll paper Pa from the paper feed part 4, a switchback mechanism 8 for reversing the transportation direction of paper Pac cut to a predetermined length after printing by the printing part 6 so that it is transportable relative to a protection treatment apparatus 10 disposed right beneath the printing part 6, a protection treatment apparatus 10 disposed on the lower part of an enclosure 2 of the printing apparatus for heat protecting the image formed on the recording surface of the paper Pac, and a delivery part 12 for discharging out the paper Pac delivered from the protection treatment apparatus 10.

The roll paper Pa in the paper feed part 4 is wound round a paper pipe Pc which is rotatably supported in a cartridge 50 detachably disposed at a predetermined position in the enclosure 2. In the cartridge 50, another roll paper Pa' of a different type which will be described later can be selectively provided. At an end of the paper pipe Pc, an output shaft of a drive motor 100 which will be described later is selectively connected. This makes the drive motor 100 operative when the cartridge 50 is attached, for example, so that a leading head of the roll paper Pa reaches a pulling rollers 14A and 14B. The drive motor 100 is controlled by a control unit 70 which will be described later.

The recording surface of the roll paper Pa has a multilayer construction comprised of, for example, a protective layer as an ink-permeable porous polymer layer which is disposed on the outermost surface layer and an ink absorption retaining layer which is disposed under the protective layer.

When ink adheres to the recording surface of such a roll paper Pa, the ink penetrates the protective layer and reaches the ink absorption retaining layer. After that, when the printed recording surface is heat treated under pressure by the protection treatment apparatus 10 which will be described later, by the heat treatment, the protective layer is changed to a flat transparent film, thereby protecting the image. By this treatment, the protective layer protects the ink absorption retaining layer to improve the water resistance and weather resistance of the roll paper Pa. At this moment, moisture of the ink absorbed into the roll paper Pa evaporates.

Further, at a predetermined position of the case of the cartridge 50, an identification pin 50pa is movably provided on the case of the cartridge 50 which indicates whether a roll paper Pa for protection treatment or a roll paper Pa' not requiring protection treatment is contained. When the identification pin 50pa is, for example, at a first position shown by the solid line in FIG. 2, it represents that the roll paper Pa for protection treatment is contained in the cartridge 50, or when the identification pin 50pa is at a second position shown by the broken line in FIG. 2, it represents that the roll paper Pa' not requiring protection treatment is contained in the cartridge 50. That is, the position of the identification pin 50pa on the case of the cartridge 50 is set according to the type of the roll paper contained.

Still further, at a position opposing the identification pin 50pa on the case of the cartridge 50, an identification sensor 52 is provided for detecting that the identification pin 50pa is at the first position to transmit a detection output signal. The identification sensor 52 is, for example, a microswitch, when it is a microswitch, for example, its contactor contacts against the identification pin 50pa to transmit a detection output signal. The identification sensor 52 is not limited to the above example, but may be an optical or magnetic proximity sensor.

When the pulling rollers 14A and 14B disposed between the printing part 6 and the paper feed part 4 are operative, the leading head of the roll paper Pa is cooperatively pinched to be transported along the direction of the arrow to the vicinity of a transportation roller 26B and a pinch roller 26A. One of the pulling rollers 14A and 14B is connected to the output shaft of a drive motor 102 which will be described later. Consequently, when the drive motor 102 is in operation, the pulling rollers 14A and 14B are rotated. The drive motor 102 is controlled by a control unit 70 which will be described later.

Yet further, a transportation passage 18 between the pulling rollers 14A and 14B and a transportation roller 26B and the pinch roller 26A is provided with a position sensor 20 for detecting arrival of the leading head of the pulled-out roll paper Pa and transmitting a detection output signal.

The printing part 6 mainly comprises an ink-jet head cartridge including a print head 24 for ejecting ink to the recording surface of the roll paper Pa to perform printing operation, a carriage member 22 selectively mounting the ink-jet head cartridge, a pair of guide shafts (not shown) for supporting the carriage member 22 equipped with the print head 24 to be movable reciprocally in a vertical direction relative to the paper surface, driving means for moving reciprocally the carriage member 22.

Each separate print head and ink tank may be able to be detachable the mounting part of the carriage member 22. Further, the print head 24 may be a print head of full-line type, has an ink ejection opening array more than the length of wide of the roll paper Pa.

The ink-jet head cartridge has a structure to be selectively detachable to the mounting part of the carriage member 22, and stores therein a predetermined colored ink. At the part of the ink-jet head cartridge opposing the recording surface of the roll paper Pa, the print head 24 is provided. For example, a print head of a bubble-jet type has an ink ejection opening forming surface opposing the recording surface of the roll paper Pa. On the ink ejection opening forming surface, a plurality of ink ejection openings are aligned and formed at predetermined intervals along the transportation direction of the roll paper Pa.

In each ink flow passage communicating with each ink ejection opening, a heater as an electrothermal converter for heating ink to eject ink by a film boiling phenomenon is provided.

Yet further, the heater of the print head 24 is controlled according to drive control pulse signals based on image data from a printing operation control part 98 which will be described later.

Beneath the printing part 6, the transportation roller 26B and the pinch roller 26A for intermittently transporting the roll paper Pa according to the printing operation of the printing part 6, and auxiliary rollers 28A and 28B interlocking in synchronization with the transportation roller 26B and the pinch roller 26A are disposed in the transportation passage. Further, between the transportation roller 26B and the pinch roller 26A and the auxiliary rollers 28A and 28B, a platen member Pu is provided opposite to the print head 24. The platen member Pu supports the recording surface of the roll paper Pa from the lower side for maintaining in a flat state, so that the distance between the ink ejection opening forming surface of the print head 24 and the recording surface is appropriately regulated.

In the transportation passage, at the downstream side of the auxiliary rollers 28A and 28B, a rotary cutter unit 30 for cutting the roll paper Pa to a predetermined length is provided. In the rotary cutter unit 30, for example, the cutter of one side is moved in a vertical direction to the paper surface by a drive motor, thereby cutting an upstream side end of the roll paper Pa. Between the rotary cutter unit 30 and the switchback mechanism part 8, intermediate rollers 32A and 32B for transporting the roll paper Pac cut to the predetermined length towards the downstream side of the transportation passage are disposed.

Further, between the intermediate rollers 32A and 32B and the rotary cutter unit 30, a position sensor 16 is provided for detecting arrival of the upstream end of the cut and transported roll paper Pac at a predetermined position and transmitting a detection output signal.

The switchback mechanism part 8 comprises a guide member 36 for guiding the roll paper Pac transported by the intermediate rollers 32A and 32B, a D cut roller 34A and a pinch roller 34B which will be described later.

The D cut roller 34A and the pinch roller 34B cooperate with each other, when, as shown by the solid line in FIG. 2, the guide member 36 is in a position where the recording surface of the roll paper Pa guided by the guide member 36 is almost parallel with the ink ejection opening forming surface of the print head 24, so that the roll paper Pa guided by the guide member 36 is transported further towards the downstream side. On the other hand, the D cut roller 34A and pinch roller 34B, as shown by the broken line in FIG. 2, when the guide member 36 is in a stand-by position crossing with the transportation direction of the roll paper, cooperate to supply the cut paper Pac towards a heat protection treatment apparatus 10 located beneath.

The thin plate-formed guide member 36 has flat surfaces parallel with each other, and the central part thereof is fixed to a rotary shaft supported on an enclosure 2 to be rotatable in a predetermined angular range. The rotary shaft is connected to an output shaft of a drive motor which will be described later. The drive motor is controlled by a control unit 70 which will be described later.

The D cut roller 34A and pinch roller 34B are fixed respectively to rotary shafts extending in directions parallel to each other and almost perpendicular to the paper surface. The rotary shaft fixed with the D cut roller 34A is connected to an output shaft of a drive motor as an actuator which will be described later. The drive motor is controlled by a control unit 70 which will be described later.

When the drive motor is in operation, the D cut roller 34A and pinch roller 34B are rotated by one turn in one direction and stopped until the roll paper Pa is cut and its upstream end is transported into one flat surface of the guide member 36, and then the D cut roller 34A and pinch roller 34B are rotated by one turn in another direction when the upstream end of the cut paper Pac obtained is guided to the other flat surface of the guide member 36 to be supplied to the protection treatment apparatus which will be described later.

Therefore, when the guide member 36 is at a position shown by the solid line in FIG. 2, by rotating the D cut roller 34A and pinch roller 34B in one direction, side part of downstream end of the subsequently printed roll paper Pa is exposed to the outside through an opening 2*a* provided at a position opposing the D cut roller 34A and pinch roller 34B in the enclosure 2.

Next, when the printed roll paper Pa reaches a predetermined length, a part of the roll paper Pa opposing the rotary cutter unit 30 is cut by the rotary cutter unit 30, then the D cut roller 34A and pinch roller 34B are rotated by one turn in one direction and stopped so that the cut portion of the obtained paper Pac is guided by the guide member 36.

Subsequently, after the guide member 36 is rotated from the position shown by the solid line in FIG. 2 to the stand-by position shown by the broken line, the D cut roller 34A and pinch roller 34B are rotated by one turn in the other direction. By this operation, the cut end side of the printed paper Pac is guided by the other flat surface of the guide member 36 and reaches between the outer peripheral part of a transportation roller 38A and the outer peripheral part of a transportation roller 38B.

The transportation roller 38A and the transportation roller 38B are disposed at the right side diagonally beneath the D cut roller 34A and the pinch roller 34B in FIG. 2. At least one of the transportation roller 38A and the transportation roller 38B is connected with an output shaft of a drive motor which will be described later. The drive motor is controlled by the control unit 70 which will be described later.

At this time, the transportation rollers 38A and 38B, and carrier rollers 42A and 42B in the protection treatment apparatus 10 are rotated in synchronization so that the printed paper Pac is transported to the protection treatment apparatus 10.

The protection treatment apparatus 10 comprises carrier rollers 42A and 42B for cooperatively pinching and guiding the leading head of the paper Pac guided by the guide member 36 and protection treatment rollers 44A and 44B for successively heating and treating the paper Pac guided by the carrier rollers 42A and 42B.

The carrier rollers 42A and 42B are disposed so that positions of respective contact surfaces thereof and positions of contact surfaces of the transportation rollers 38A and 38B are on the same plane.

The carrier rollers 42A and 42B are connected with the output shaft of the drive motor through a one-way clutch to interlock with the transportation rollers 38A and 38B. The drive motor is controlled by the control unit 70 which will be described later to be selectively driven to rotate at a constant speed and stopped. The rotational speeds of the carrier rollers 42A and 42B are set to a slightly lower than the rotational speeds of the protection treatment rollers 44A and 44B. A sheet of paper Pac reaching the carrier rollers 42A and 42B is guided by the rotation of the carrier rollers 42A and 42B to between the outer peripheral part of the protection treatment roller 44A and the outer peripheral part of the protection treatment roller 44B.

The one-way clutch, when the leading head of the paper Pac is introduced and the outer peripheral part of the carrier rollers 42A and 42B is applied with a rotational load, transmits a driving force, on the other hand, the one-way clutch, when applied with a rotational force in the same direction as the rotational direction through the paper Pac by the protection treatment rollers 44A and 44B at the downstream side of the transportation passage, does not transmit a driving force.

That is, when the paper Pac is pinched by the protection treatment rollers 44A and 44B to be in a transportation state, since the driving force is not transmitted by the one-way clutch, the carrier rollers 42A and 42B are driven by a friction of the transported paper Pac. This prevents unnecessary compression or buckling of the paper Pac between the carrier rollers 42A and 42B and the protection treatment rollers 44A and 44B.

The protection treatment rollers 44A and 44B are disposed so that a rotational axis thereof is at a position diagonally beneath generally parallel with a rotational axis of the carrier rollers 42A and 42B. The outer peripheral part of the protection treatment roller 44A and the outer peripheral part o the protection treatment roller 44B contact with each other. One of the protection treatment rollers 44A and 44B is connected with an output shaft of a drive motor which will be described later. The drive motor is controlled by the control unit 70 which will be described later. At this time, transportation speed of the paper Pac pinched by the protection treatment rollers 44A and 44B is set to nearly the same speed as an average speed per unit time of the intermittent transportation operation of the printing part 6.

Further, the cylindrical protection treatment rollers 44A and 44B respectively have heater 44AH and heater 44BH inside thereof. The heater 44AH and the heater 44BH respectively heat the outer peripheral parts of the rotated protection treatment rollers 44A and 44B. The heater 44AH and the heater 44BH are controlled by the control unit 70 which will be described later.

With this construction, the protection treatment rollers 44A and 44B perform heat treatment while applying a pressure to a sheet of paper Pac. Therefore, by the heat treatment, the protective layer of the paper Pac is changed to a flat transparent film, thus protection treating the image on the recording surface.

Between the carrier rollers 42A and 42B and the protection treatment rollers 44A and 44B, a paper end detection sensor 40 is provided for detecting respective passage of the feeding direction side end of a sheet of paper Pac and its opposite end and transmitting a detection output signal.

The protection treated paper Pac is successively pulled out from the protection treatment rollers 44A and 44B by discharge rollers 46A and 46B and discharged from the protection treatment apparatus 10.

The paper Pac discharged from the protection treatment apparatus 10 is pinched by the discharge rollers 46A and 46B of the delivery part 12 to be discharged to the outside through a discharge port 12*a*.

Figure 1:
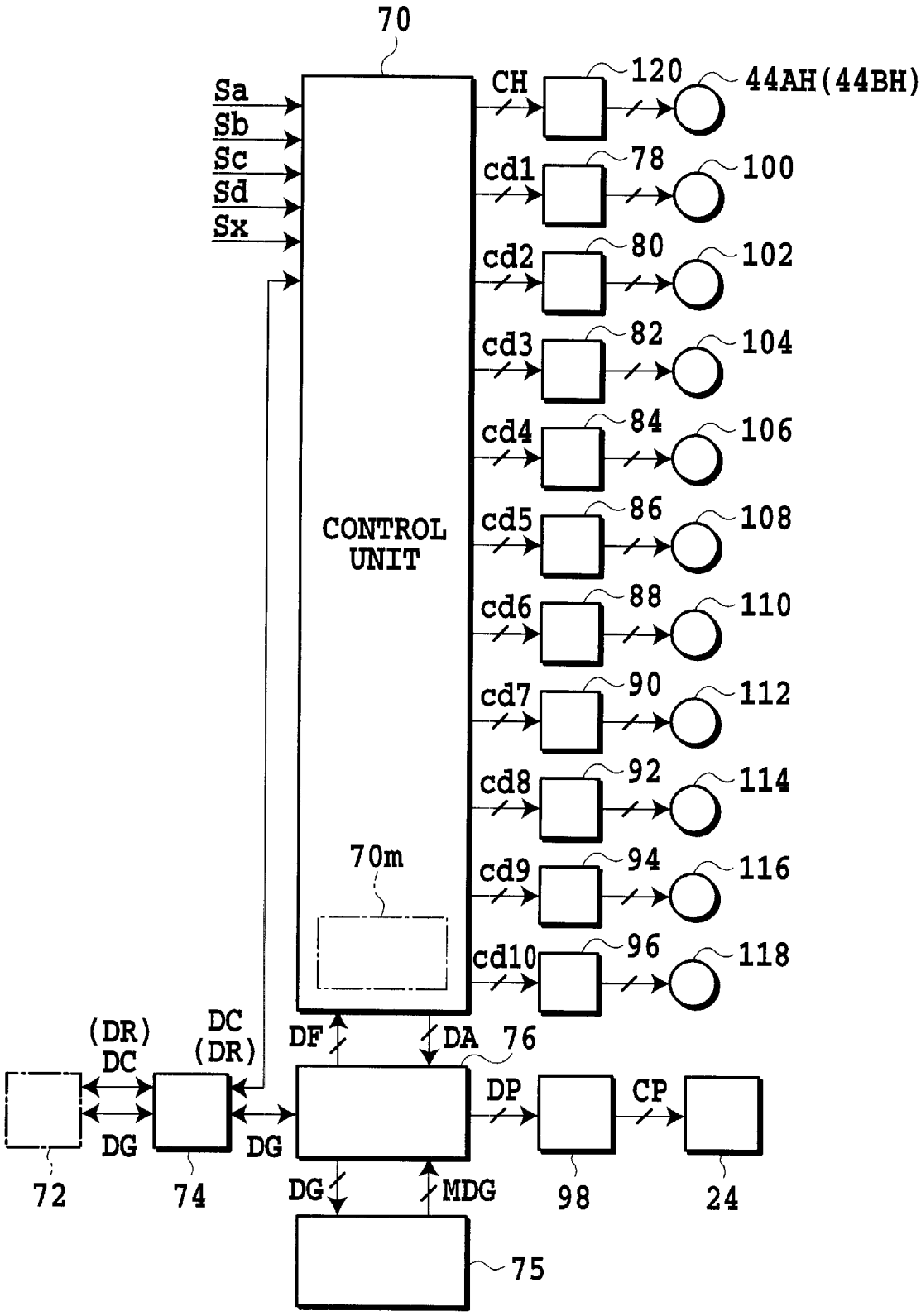
FIG. 1 is a block diagram showing the construction of a control block provided in a first embodiment of the image forming apparatus according to the present invention.

In addition, the first embodiment of the image forming apparatus according to the present invention, as shown in FIG. 1, is provided with the control unit 70 for performing operation control of the above respective drive motors and operation control of the heaters 44AH and 44BH.

In FIG. 1, the control unit 70 is supplied with a detection output signal Sa from the above identification sensor 52, a detection output signal Sb from the position sensor 20, a detection output signal Sc from the position sensor 16, a detection output signal Sd from the paper end detection sensor 40, or the like. Further, a control data group DC required for printing operation control from a host computer 72 connected to a bi-directional communication line through a communication part 74 is supplied to the control unit 70. The communication part 74 transmits a data group DR including a data representing transmission abnormality state such as paper jamming from the control unit 70, or data representing in-calculation and the like to the host computer 72 side.

The control unit 70 has a memory part 70m for storing the control data group DC, transportation control and printing operation control program data and the like.

Further, the control unit 70 is connected with an image processing part 76. The image processing part 76 is supplied with an image data group DG supplied for a predetermined amount, for example, one scan or data amount to be printed on a sheet of paper through the communication part 74 from the host computer 72. The image data group DG is written on the memory part 75 at a predetermined timing, and an image data MDG provided for printing is read out from the memory part 75 according to a read timing signal from the image processing part 76.

The image processing part 76 performs density conversion processing, binarization and registration adjustment of the print head according to the read image data MDG and the control data DA from the control unit 70, forms a printing control data group DP and supplies it to a printing operation control part 98. Further, the image processing part 76 supplies a data group DF including data representing end of processing to a predetermined amount of image data to the control unit 70.

The printing operation control part 98 forms a drive control pulse signal group CP on the basis of the printing control data group DP and supplies it to the print head part 24. By this operation, the print head part 24, which is reciprocally moved in the vertical direction to the paper surface in FIG. 2, performs printing operation to the recording surface of the roll paper Pa intermittently transported according to the drive control pulse signal group CP.

Figure 5:
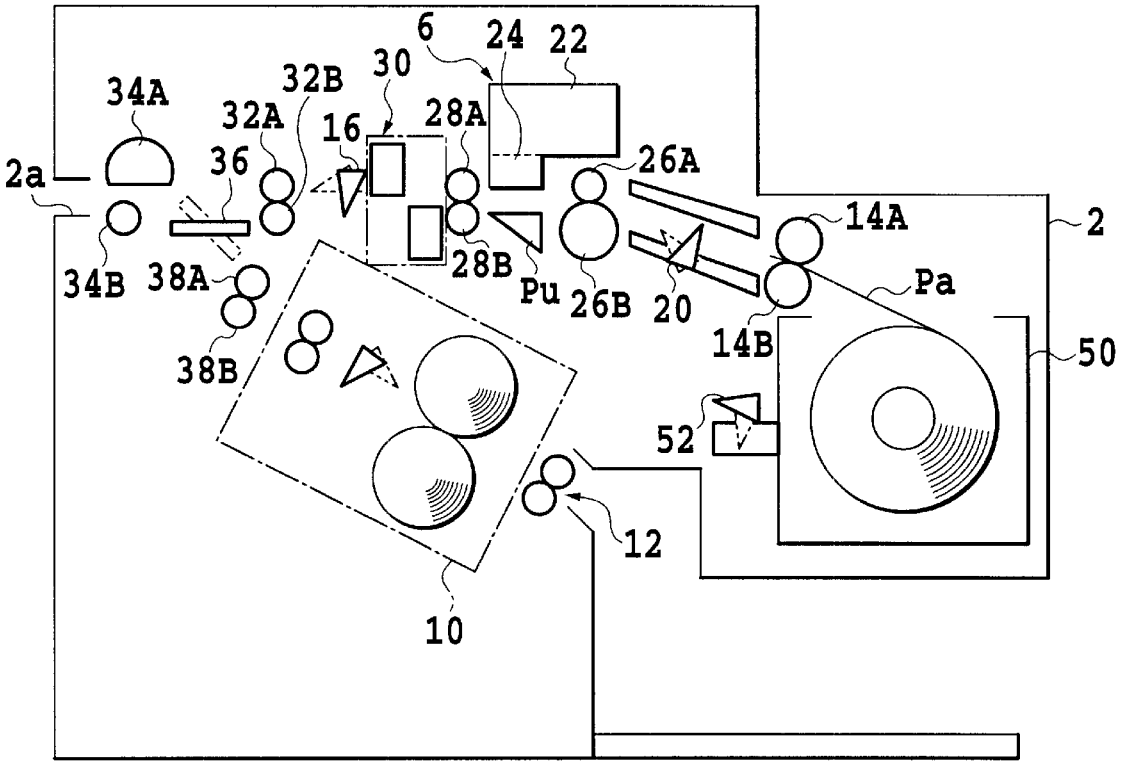
FIG. 5 is a diagram used for explaining operation of the first embodiment of the image forming apparatus according to the present invention.

Still further, the control unit 70, first, when it is determined according to the detection output signal Sa from the identification sensor 52 that a roll paper for protection treatment is contained in the cartridge set 50, as shown in FIG. 5, forms a control signal Cd1 to pull out the leading head of the roll paper Pa by the pulling rollers 14A and 14B, and supplies it to a drive circuit part 78. The drive circuit part 78 forms a drive control pulse signal according to the control signal Cd1, and supplies it to the drive motor 100.

Figure 6:
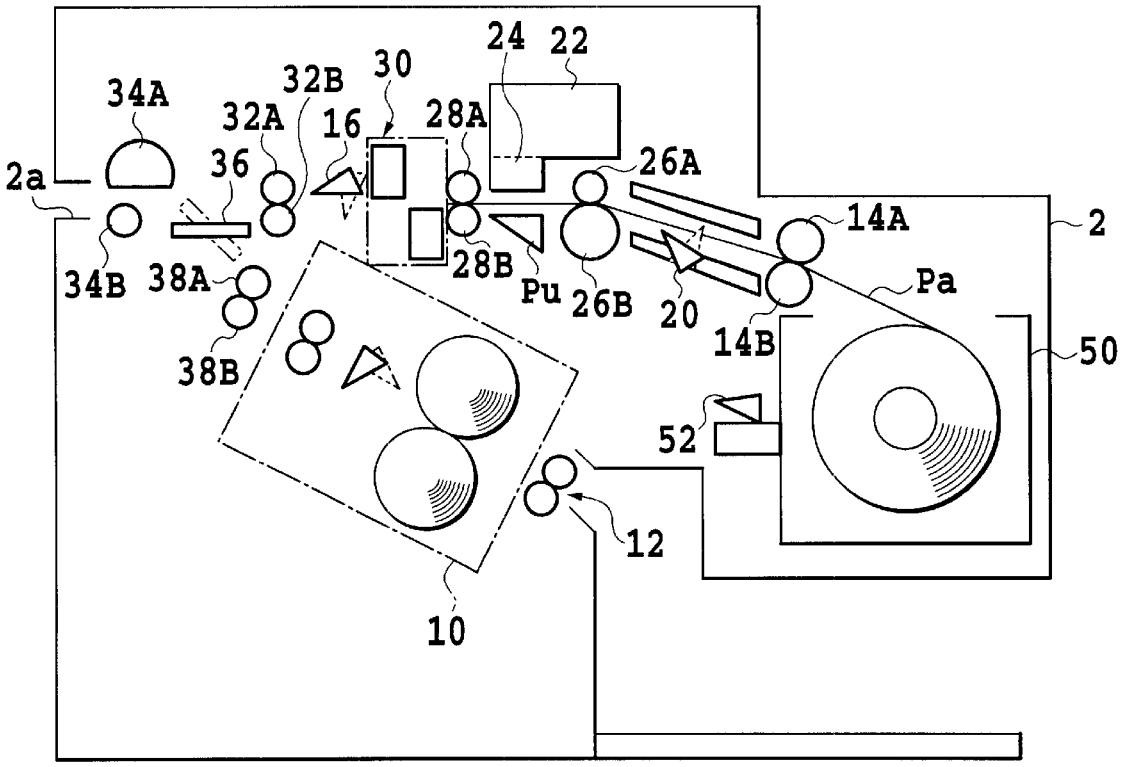
FIG. 6 is a diagram used for explaining operation of the first embodiment of the image forming apparatus according to the present invention.
Figure 19:
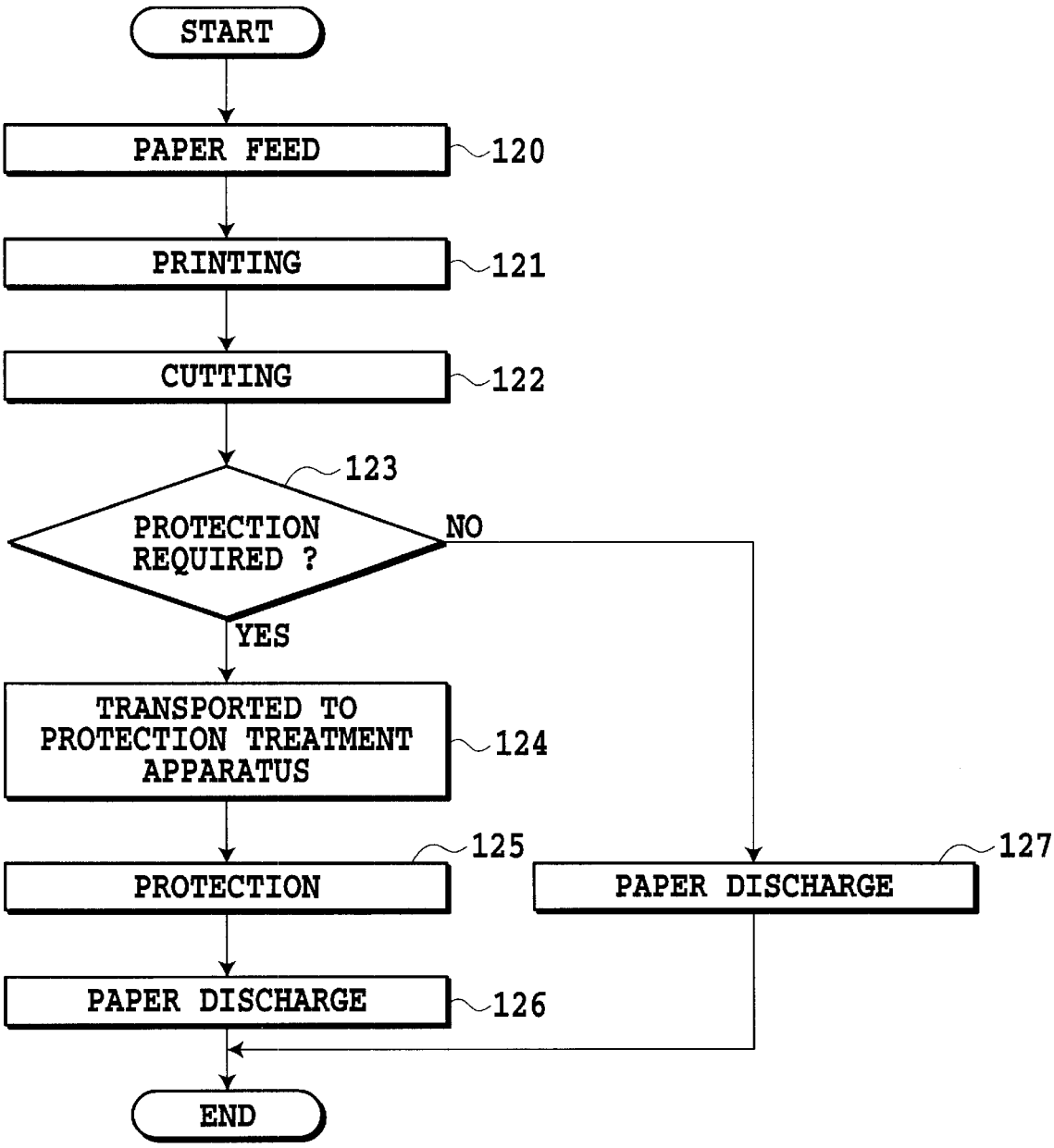
FIG. 19 is a diagram used for explaining a series of control processes in the first embodiment of the image forming apparatus according to the present invention.

Next, the control unit 70, as shown in FIG. 2 and FIG. 6, forms a control signal Cd2 to transport the roll paper Pa so that the recording surface of the roll paper Pa reaches a predetermined position beneath the print head 24, and supplies it to a drive circuit part 80. The drive circuit part 80 forms a drive control pulse signal according to the control signal Cd2, and supplies it to the drive motor 102. At this moment, the control unit 70 forms a control signal Cd3 to transport a predetermined length of roll paper Pa according to the detection output signal Sb from the position sensor 20, and supplies it to the drive circuit part 82. By this operation, the transportation roller 26A and the pinch roller 26B are rotated by a predetermined number of turns so that the leading head of the roll paper Pa reaches a predetermined position beneath the print head 24. Thus, as shown in FIG. 19, paper feed of the roll paper Pa is performed (step 120).

Figure 7:
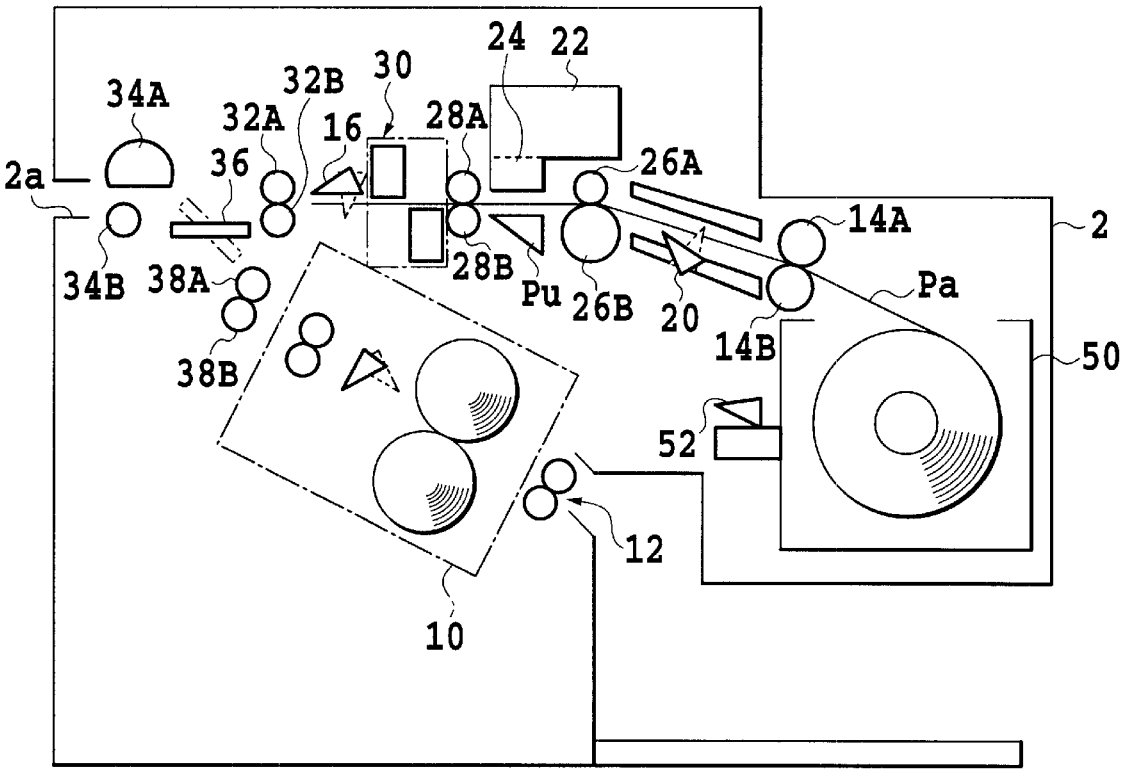
FIG. 7 is a diagram used for explaining operation of the first embodiment of the image forming apparatus according to the present invention.

Next, the control unit 70, as shown in FIG. 7, supplies a control signal to reciprocally move the carriage member 22 to the transportation control part (not shown) by a predetermined distance in the vertical direction, forms a control signal Cd3 to intermittently transport the roll paper Pa of every predetermined amount, and supplies it to the drive circuit part 82. Further, the control unit 70 supplies the control data DA to the image processing part 76. By this operation, image is successively formed on the recording surface of the transported roll paper Pa (step 121 in FIG. 19).

Figure 8:
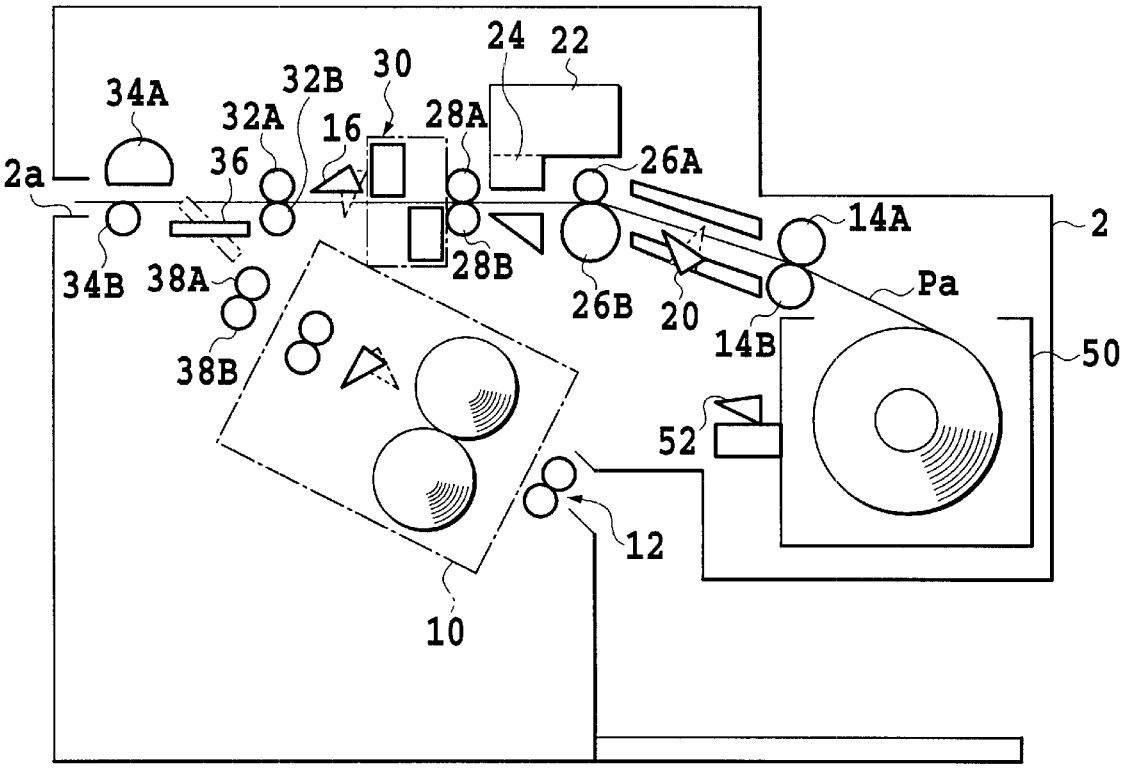
FIG. 8 is a diagram used for explaining operation of the first embodiment of the image forming apparatus according to the present invention.

Next, the control unit 70, as shown in FIG. 8, after the completion of printing operation, forms the control signal Cd3 to form a predetermined space in the boundary part with an unprinted part continued from the printed surface of the printed roll paper Pa so that the roll paper Pa stops at a predetermined position beneath the rotary cutter unit 30, and supplies it to the drive circuit part 82. At this moment, the control unit 70 forms a control signal Cd4 to operate the rotary cutter unit 30, and supplies it to the drive circuit 84. By this operation, a drive motor 106 is made operative, a predetermined position on the recording surface of the roll paper Pa beneath the rotary cutter unit 30 is cut to obtain a sheet of printed paper Pac (step 122 in FIG. 19).

Figure 9:
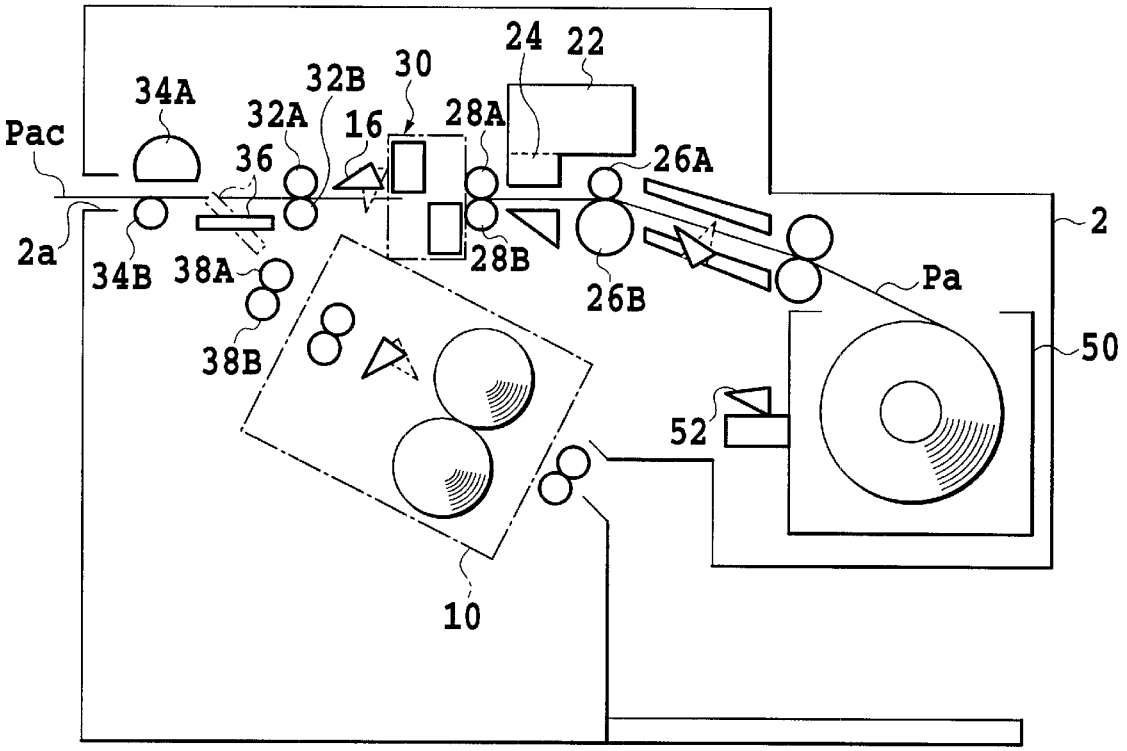
FIG. 9 is a diagram used for explaining operation of the first embodiment of the image forming apparatus according to the present invention.

The control unit 70, as shown in FIG. 9, supplies the control signal Cd1 to the drive circuit part 78 so that the cut part of the recording surface of the roll paper Pa is returned to a predetermined position beneath the print head 24. By this operation, as shown in FIG. 9, the cut part of the recording surface of the roll paper Pa is stopped at a predetermined printing start position.

Figure 10:
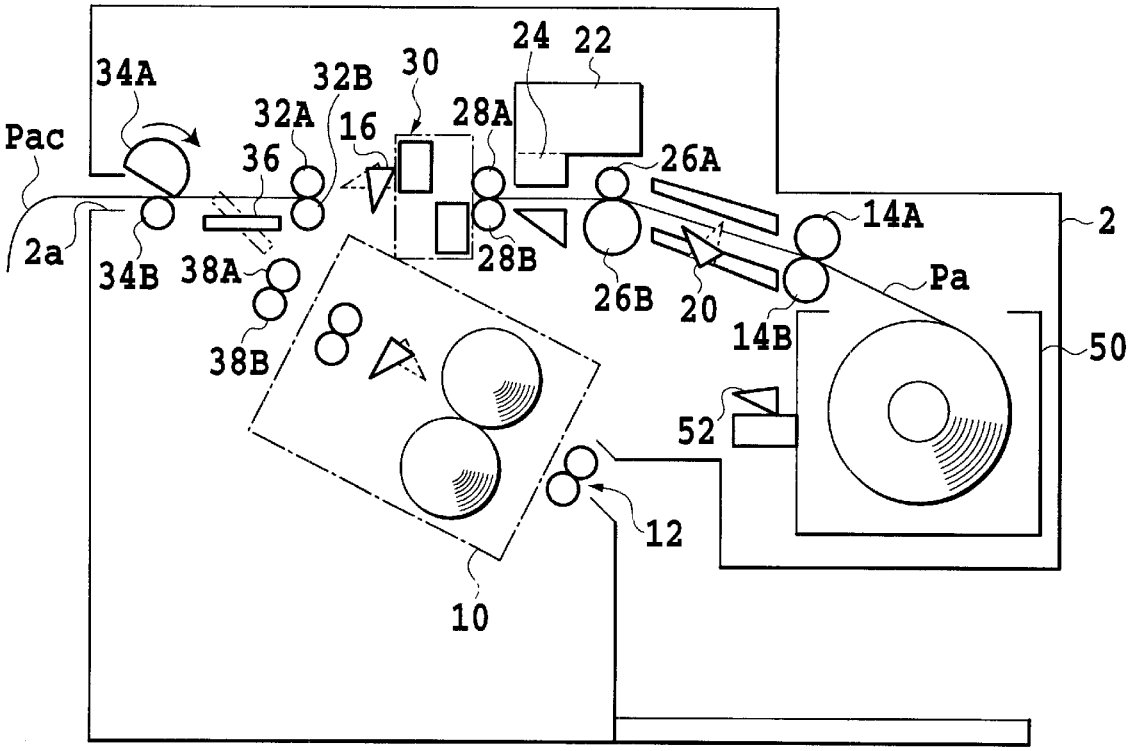
FIG. 10 is a diagram used for explaining operation of the first embodiment of the image forming apparatus according to the present invention.

Next, the control unit 70, when the paper Pac is determined to require protection treatment according to the detection output signal Sa (step 123 in FIG. 19), as shown in FIGS. 9 and 10, supplies a control signal Cd5 to a drive circuit part 86 to further transport by a predetermined length the paper Pac, forms a control signal Cd6 to rotate the D cut roller 34A and the pinch roller 34B by about one turn, and supplies it to the drive circuit part 88. By this operation, the drive motors 108 and 110 are made operative, and the D cut roller 34A and the pinch roller 34B are rotated.

In this case, the guide member 36, as shown by the solid line in FIG. 9, is maintained to be parallel with the recording surface of the paper Pac. Further, a feeding direction end of the paper Pac is protruded to the outside through an opening 2*a*.

Figure 11:
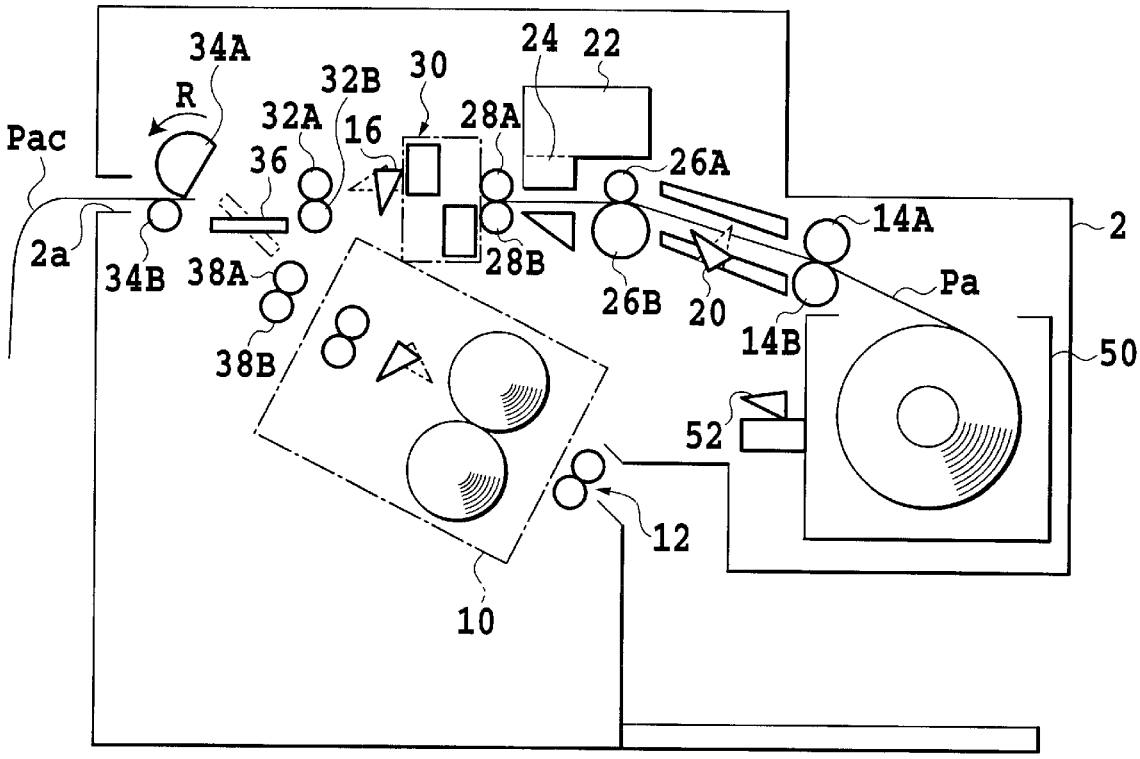
FIG. 11 is a diagram used for explaining operation of the first embodiment of the image forming apparatus according to the present invention.

Next, the control unit 70, when rotated by a predetermined angle until the D cut roller 34A and the pinch roller 34B become from the state shown in FIG. 10 to the state shown in FIG. 11, stops supply of the control signal Cd6. By this operation, a greater part of the paper Pac, as shown in FIG. 11, is exposed to the outside through the opening 2*a*.

Figure 12:
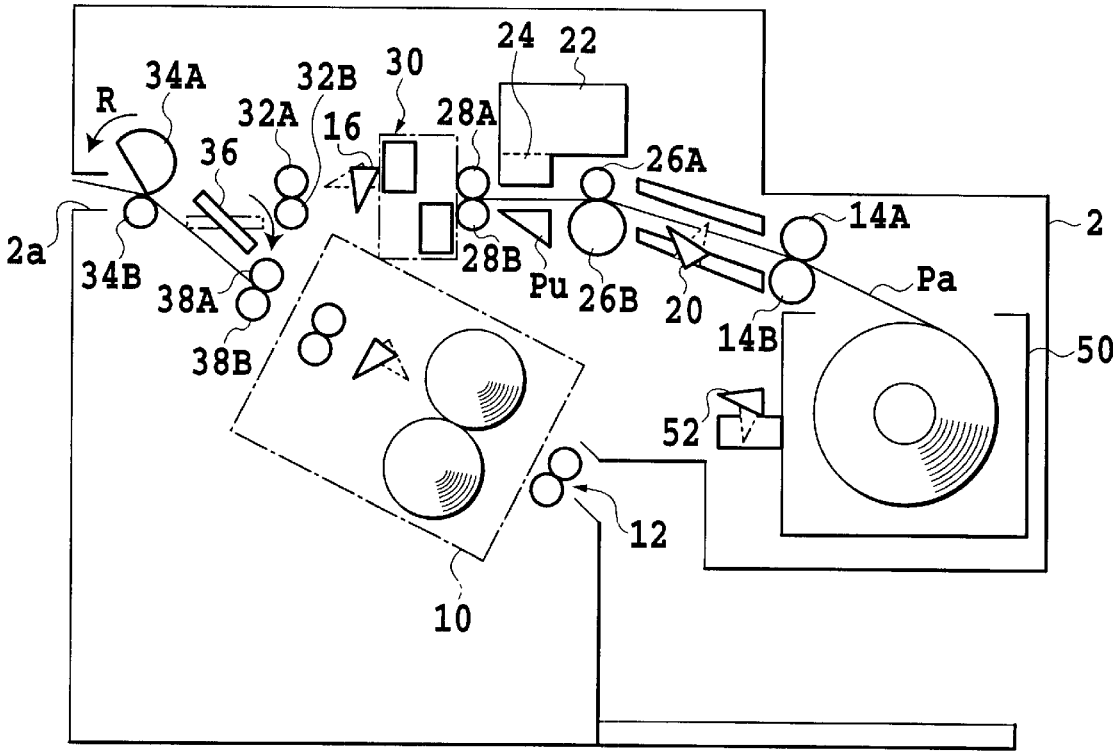
FIG. 12 is a diagram used for explaining operation of the first embodiment of the image forming apparatus according to the present invention.

Next, the control unit 70, as shown in FIG. 12, forms a control signal Cd7 to rotate the guide member 36 by a predetermined angle towards right side diagonally beneath, and supplies it to a drive circuit part 90, forms the control signal Cd6 to rotate the D cut roller 34A from the state shown in FIG. 11 in a direction shown by the arrow R in FIGS. 11 and 12, and supplies it to a drive circuit 88. By this operation, the drive motors 110 and 112 are made operative, the paper Pac is guided from its upstream end to the other surface of the guide member 36 to reach the transportation rollers 38A and 38B.

Figure 13:
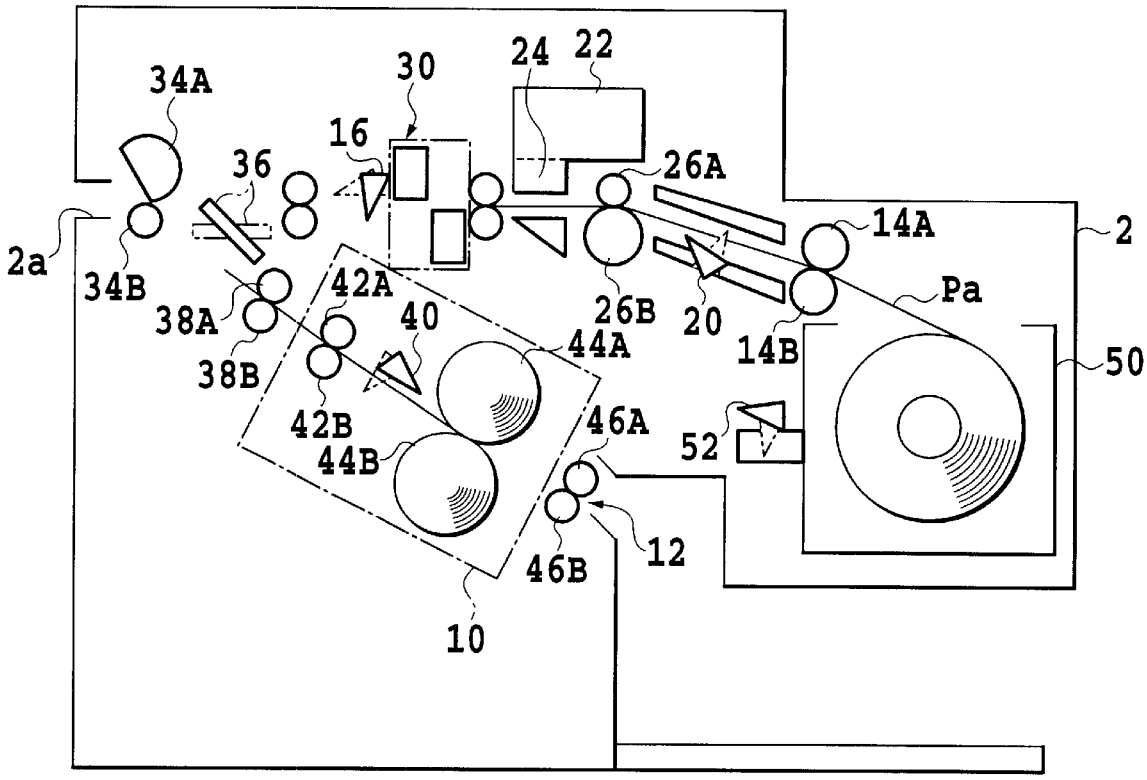
FIG. 13 is a diagram used for explaining operation of the first embodiment of the image forming apparatus according to the present invention.

Next, the control unit 70, as shown in FIG. 13, forms control signals Cd8 and Cd9, respectively, to guide the paper Pac into the protection treatment apparatus for protection treatment of the paper Pac, and supplies them to drive circuits 92 and 94 (step 124 in FIG. 19). Further, the control unit 70 forms the control signal CH according to the detection output signal Sx to maintain the heater 44AH and the heater 44BH at predetermined temperatures, and supplies it to a drive circuit 120.

By this operation, the drive motors 114 and 116 are made operative, the paper Pac is transported into the protection treatment apparatus 10, pinched by the protection treatment rollers 44A and 44B, and protection treatment to heat the paper Pac to a predetermined temperature is performed (step 125 in FIG. 19).

Figure 14:
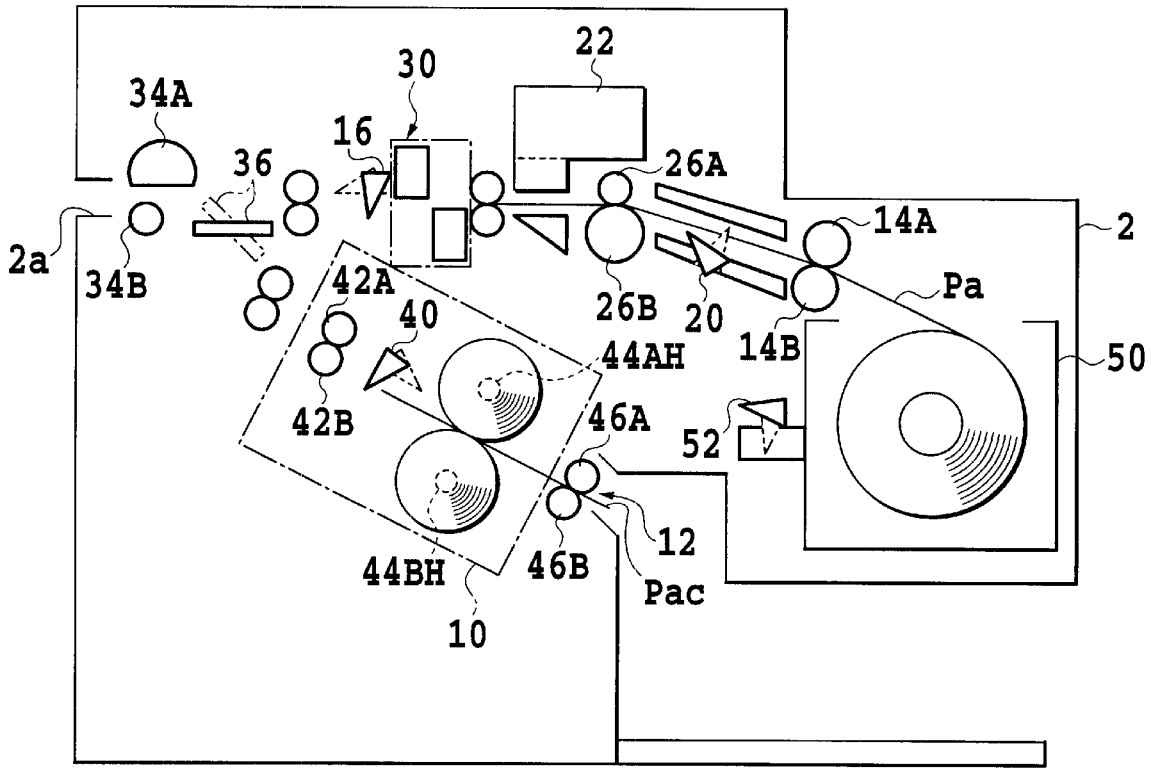
FIG. 14 is a diagram used for explaining operation of the first embodiment of the image forming apparatus according to the present invention.
Figure 15:
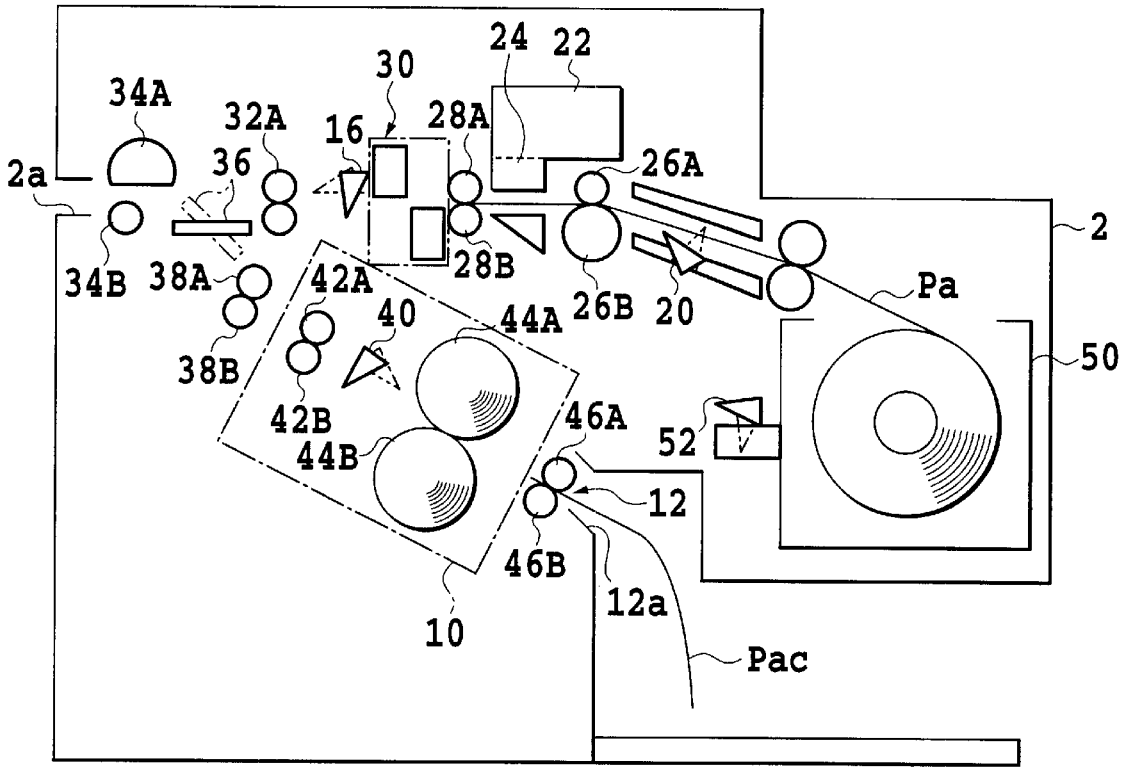
FIG. 15 is a diagram used for explaining operation of the first embodiment of the image forming apparatus according to the present invention.

Next, the control unit 70 forms a control signal Cd7 according to the detection output signal Sd to return the guide member 36 from the position of the broken line along the transportation passage to a parallel angular position, as shown in FIG. 14 and FIG. 15, and supplies the signal to the drive circuit 90, and forms a control signal Cd10 to discharge the paper Pac through the delivery part 12, and supplies it to a drive circuit part 96. The drive circuit part 96 supplies a drive control pulse signal to a drive motor 118 to make the drive motor 118 of the discharge rollers 46A and 46B operative. By this operation, the protection treated paper Pac is discharged through a discharge port 12*a* of the delivery part 12 (step 126 in FIG. 19).

Figure 16:
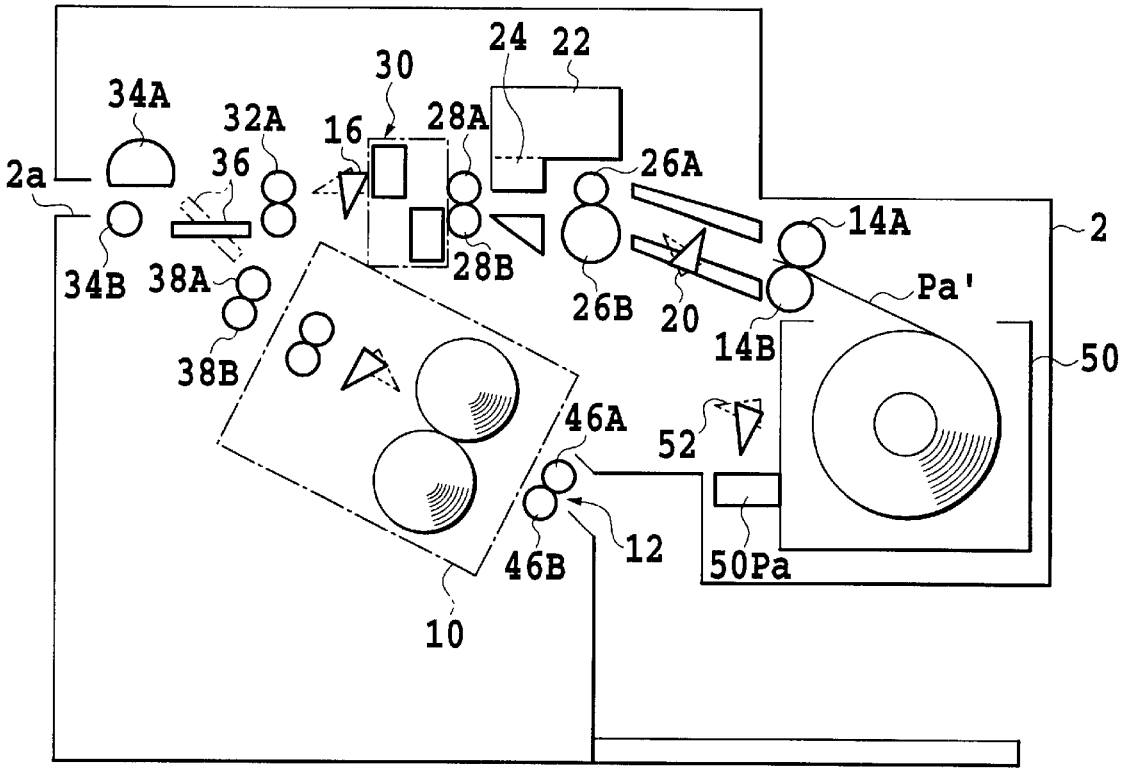
FIG. 16 is a diagram used for explaining operation of the first embodiment of the image forming apparatus according to the present invention.

On the other hand, the control unit 70, when, as shown by the solid line in FIG. 16, the identification pin 50pa is at a second position representing that a roll paper Pa' not requiring protection treatment is contained in the cartridge 50, first, when it is determined according to the detection output signal Sa that a roll paper Pa' not requiring protection treatment is contained in the cartridge 50 set, a shown in FIG. 16, forms the control signal Cd1 to pull out the leading head of the roll paper Pa' by the pulling rollers 14A and 14B, and supplies it to the drive circuit part 78. The drive circuit part 78 forms a drive control pulse signal according to the control signal Cd1, and supplies it to the drive motor 100.

Figure 17:
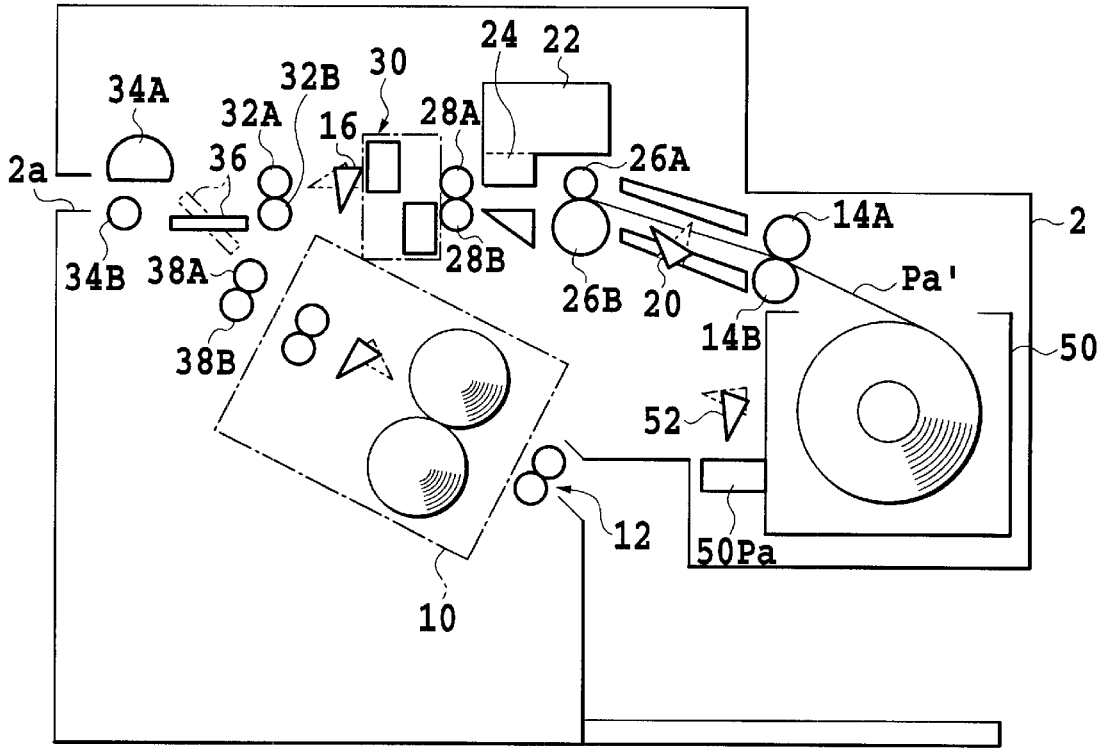
FIG. 17 is a diagram used for explaining operation of the first embodiment of the image forming apparatus according to the present invention.

Next, the control unit 70, as shown in FIG. 17 and above-described FIG. 6, forms the control signal Cd2 to transport the roll paper Pa' so that the recording surface of the roll paper Pa' reaches a predetermined position beneath the print head 24, and supplies it to the drive circuit part 80. The drive circuit part 80 forms a drive control pulse signal according to the control signal Cd2, and supplies it to the drive motor 102. At this moment, the control unit 70 forms the control signal Cd3 according to the detection output signal Sb from the position sensor 20 to feed a predetermined length of the roll paper Pa', and supplies it to the drive circuit part 82. By this operation, the transportation roller 26A and the pinch roller 26B are rotated by a predetermined number of turns so that the leading head of the roll paper Pa' reaches a predetermined position beneath the print head 24.

Next, the control unit 70, as shown in above-described FIG. 7, forms a control signal to a transportation control part (not shown) to reciprocally move the carriage member 22 in the vertical direction to the paper surface by a predetermined distance, forms the control signal Cd3 to intermittently transport the roll paper Pa' by every predetermined length, and supplies it to the drive circuit part 82. Further, the control unit 70 supplies the control data DA to the image processing part 76. By this operation, the image is successively formed on the recording surface of the transported roll paper Pa'.

Next, the control unit 70, as shown in FIG. 8, after the completion of printing operation, forms the control signal Cd3 to form a predetermined space in the boundary part with an unprinted part continued from the recording surface of the printed roll paper Pa' so that the roll paper Pa' stops at a predetermined position beneath the rotary cutter unit 30, and supplies it to the drive circuit part 82. At this moment, the control unit 70 forms the control signal Cd4 to operate the rotary cutter unit 30, and supplies it to the drive circuit 84. By this operation, a predetermined position beneath the rotary cutter unit 30 on the recording surface of the roll paper Pa is cut to obtain a sheet of printed paper Pac'.

The control unit 70, as shown in FIG. 9, supplies the control signal Cd1 to the drive circuit part 78 to return the cut portion of the recording surface of the roll paper Pa' to a predetermined position beneath the print head 24. By this operation, as shown in FIG. 9, the cut part of the recording surface of the roll paper Pa' is stopped at a predetermined printing start position.

Figure 18:
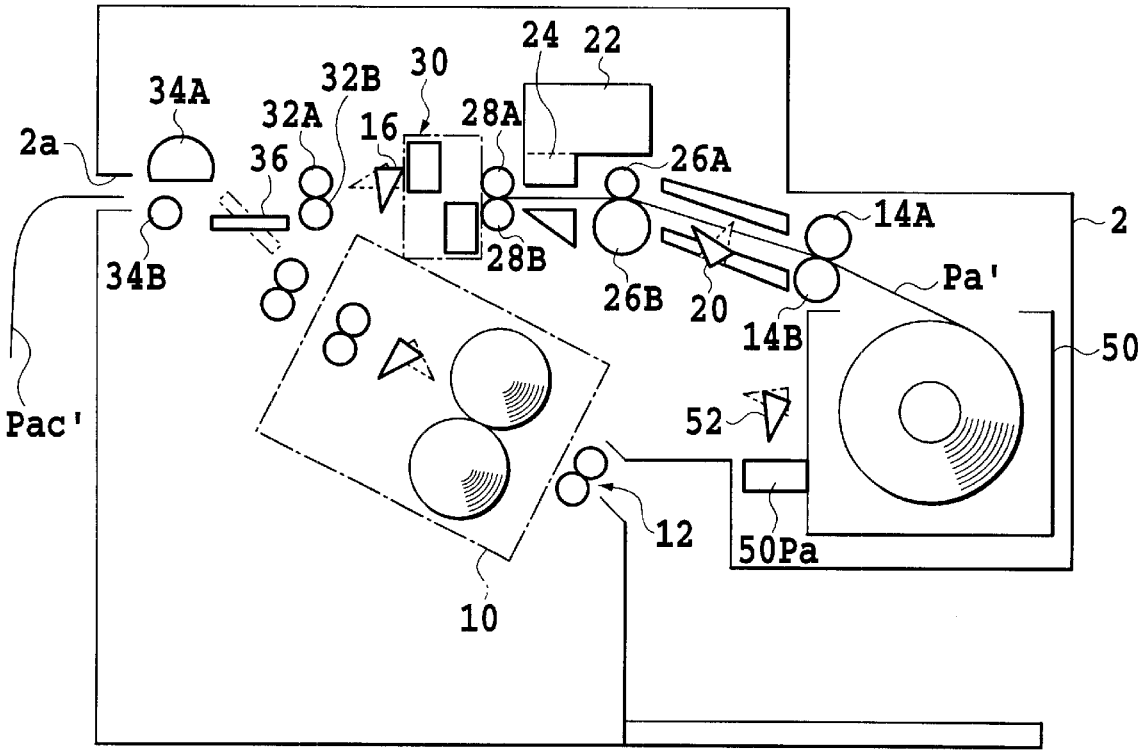
FIG. 18 is a diagram used for explaining operation of the first embodiment of the image forming apparatus according to the present invention.

Next, the control unit 70, when the paper Pac' is determined as not requiring protection treatment according to the detection output signal Sa (step 127 in FIG. 19), as shown in above-described FIGS. 9 and 10, supplies the control signal Cd5 to the drive circuit part 86 to further transport a predetermined length of paper Pac', and forms the control signal Cd6 to rotate the D cut roller 34A and the pinch roller 34B by about one turn according to the detection output signal Sc, and supplies it to the drive circuit part 88. At this moment, the guide member 36, as shown by the solid line in above-described FIG. 9, is maintained to be parallel to the recording surface of the paper Pac'. By this operation, as shown in FIG. 18, the paper Pac' is discharged to the outside from the feeding direction end through the opening 2*a*.

Therefore, by the above control, by passing the paper Pac' not requiring protection treatment over the protection treatment apparatus 10, eventual unnecessary jamming and associated scorching, generation of smokes, and deteriorating damages such as scorching to the paper Pac' due to unnecessary heating can be avoided. Further, depending on the cases, possible disorders such as sticking of the paper Pac' to the protection treatment apparatus 10, and associated scorching, and smoke generation are prevented.

In particular, when the paper Pac' is forcibly discharged through the protection treatment passage, to prevent occurrence of deterioration of quality due to heating of the paper Pac' not requiring protection treatment, the paper must be passed after the temperature of the heat protection treatment apparatus is cooled down. Further, thereafter when it is attempted to treat a printing medium requiring heat treatment, the protection treatment apparatus must be heated up again, and a waiting time is required until temperature is increased to the necessary temperature, resulting in a substantial loss of time. However, in an example of the image forming apparatus according to the present invention, these waiting times are unnecessary, and the operation time can be considerably reduced.

Figure 3:
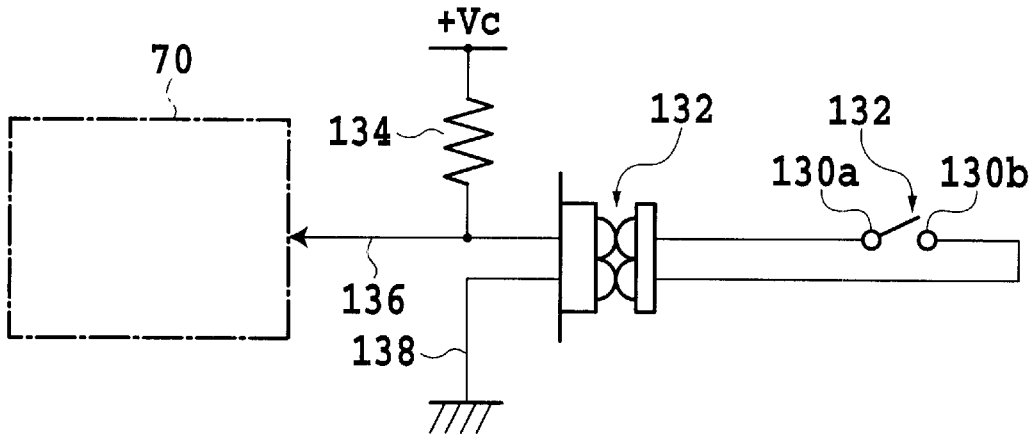
FIG. 3 is a schematic diagram showing the construction of another example of apparatus for obtaining an identification signal representing the type of printing medium contained in a cartridge used in the first embodiment of the image forming apparatus according to the present invention.

In the first embodiment of the image forming apparatus according to the present invention shown in FIG. 2, to determine whether the roll paper Pa or Pa' is contained selectively in the cartridge 50, a detection output from the identification pin 50pa or the identification sensor 52, however, instead, in the example shown in FIG. 3, for example, the length of the paper pipe Pc in the cartridge 50 is differently set according to the contained roll paper Pa or Pa', an electrical switch part 130, which is selectively turned on and off by the contact of the end of paper pipe Pc to transmit a signal representing the roll paper Pa or Pa' to the control unit 70, is provided at a position opposing the paper pipe Pc in the cartridge 50.

The switch part 130 comprises a fixed contact 130*b* and a movable contact 130*a*. The fixed contact 130*b* and the movable contact 130*a* are connected respectively to input side of a connection contact part 132. One terminal at the output side of the connection contact part 132 is connected with an end of a pull-up resistor 134. The other end of the pull-up resistor 134 is connected with a power supply Vc. Further, the other terminal at the output side of the connection contact part 132 is grounded.

Therefore, in the case of the cartridge 50 containing the roll paper Pa, when an end of its paper pipe Pc makes the movable contact 130*a* in connection state to the fixed contact 130*b*, a signal representing zero signal level (0) is supplied through a connection line 136.

Further, in the case of the cartridge 50 containing the roll paper Pa', because an end of its paper pipe Pc does not make the movable contact 130*a* in connection state to the fixed contact 130*b*, the control unit 70 is supplied with a signal representing a signal level corresponding to the power supply Vc through the connection line 136.

By this operation, the control unit 70 is possible to determine whether the roll paper Pa or Pa' is contained in the cartridge 50 according to the obtained signal.

Figure 4:
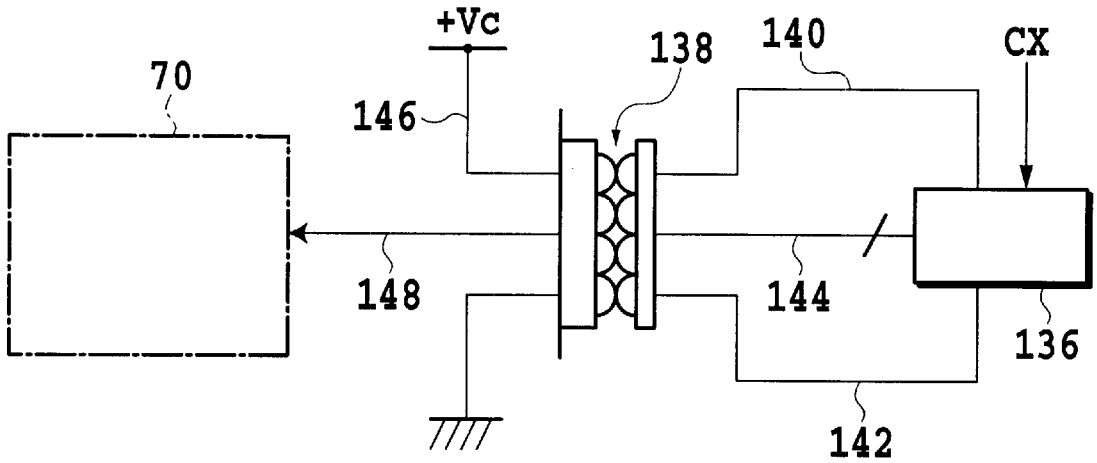
FIG. 4 is a schematic diagram showing the construction of a further example of apparatus for obtaining an identification signal representing the type of printing medium contained in a cartridge used in the first embodiment of the image forming apparatus according to the present invention.

In the example shown in FIG. 3, the electrical switch part 130 for transmitting a signal representing the roll paper Pa or Pa' to the above control unit 70, however, instead, in an example shown in FIG. 4, a memory part 136 storing a data specific to each cartridge representing that the roll paper contained in the cartridge 50 is roll paper Pa or Pa' is disposed in the cartridge 50.

The memory part 136 is connected to the input part side of the connection contact part 138 through connection lines 140 and 142. Further, a data output part of the memory part 136 is connected to the input part side of the connection contact part 138 through a connection line 144.

Still further, the memory part 136 is supplied with a control signal group CX including a read timing signal, an enable signal, a clock signal and the like from the control unit 70 at a predetermined timing, for example, when the cartridge 50 is mounted.

The output part side terminals of the connection contact part 138 are connected with the power supply Vc, and the control unit 70, respectively. The remaining terminals of the output part side of the connection contact part 138 are grounded.

Therefore, for example, in the case of the cartridge 50 containing the roll paper Pa, its memory part 136 supplies a data representing that the roll paper Pa is contained according to the control signal group CX.

By this operation, the control unit 70 is possible to determine that the roll paper Pa is contained in the cartridge 50 according to the obtained data.

[Second Embodiment]

Figure 20:
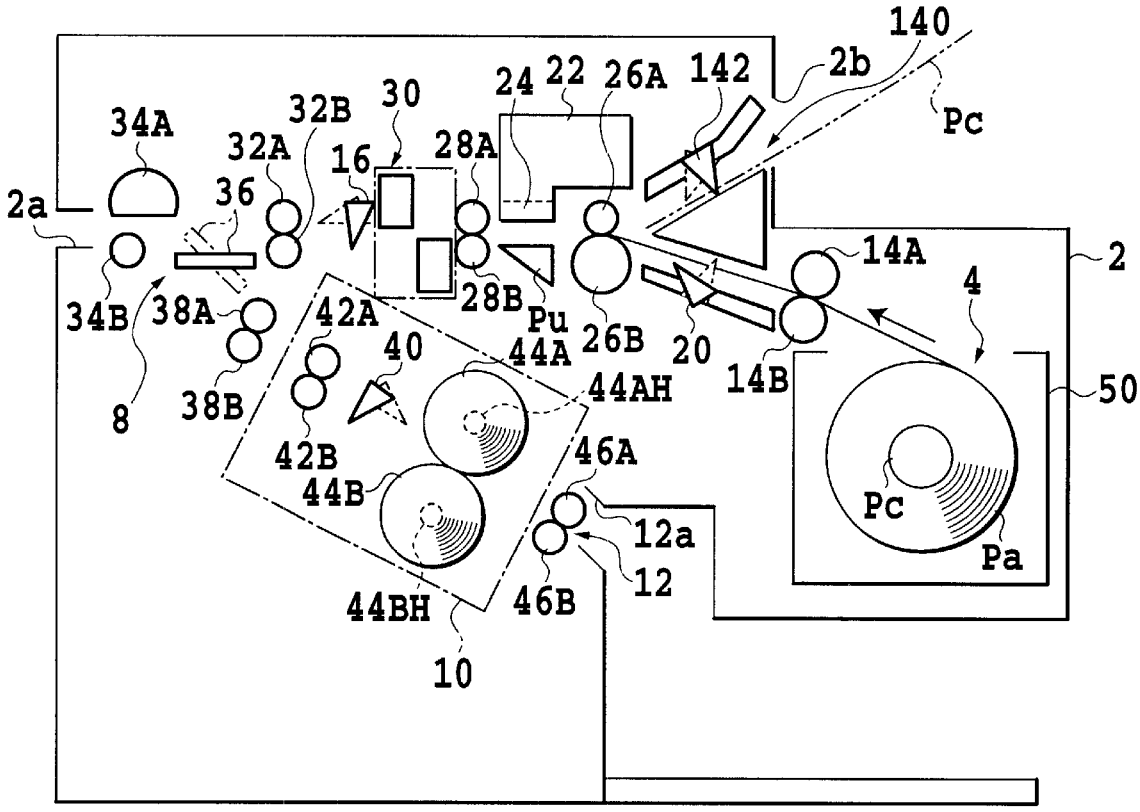
FIG. 20 is a schematic diagram showing the entire construction of a second embodiment of the image forming apparatus according to the present invention.

FIG. 20 schematically illustrates a second embodiment of the image forming apparatus according to the present invention.

In the first embodiment shown in FIG. 2, the cartridge 50 is possible to selectively contain the roll paper Pa requiring protection treatment and the roll paper Pa' not requiring protection treatment, on the other hand, in the second embodiment, only the roll paper Pa requiring protection treatment can be contained in the cartridge 50, and the paper Pc not requiring protection treatment can be inserted by hand one by one into the transportation passage.

In the example shown in FIG. 20, the same components as in the example shown in FIG. 2 are indicated with the same symbols, and detailed description thereof is omitted.

In FIG. 20, at a position above the pulling rollers 14A and 14B in the enclosure 2, an opening 2*b* for communicating the inside with the outside is provided.

At a part opposing the opening 2*b*, an end of a hand insertion passage 140 is opened. In the hand insertion passage 140, a paper feed sensor 142 is provided for detecting that an end of the inserted paper Pc is placed in the hand insertion passage 140 and transmitting a detection output signal.

The hand insertion passage 140 is diagonally formed to cross with a plane including the contact surface of the transportation roller 26B and the pinch roller 26A. The other end of the hand insertion passage 140 joins the downstream side of the transportation passage of the roll paper Pa.

Figure 21:
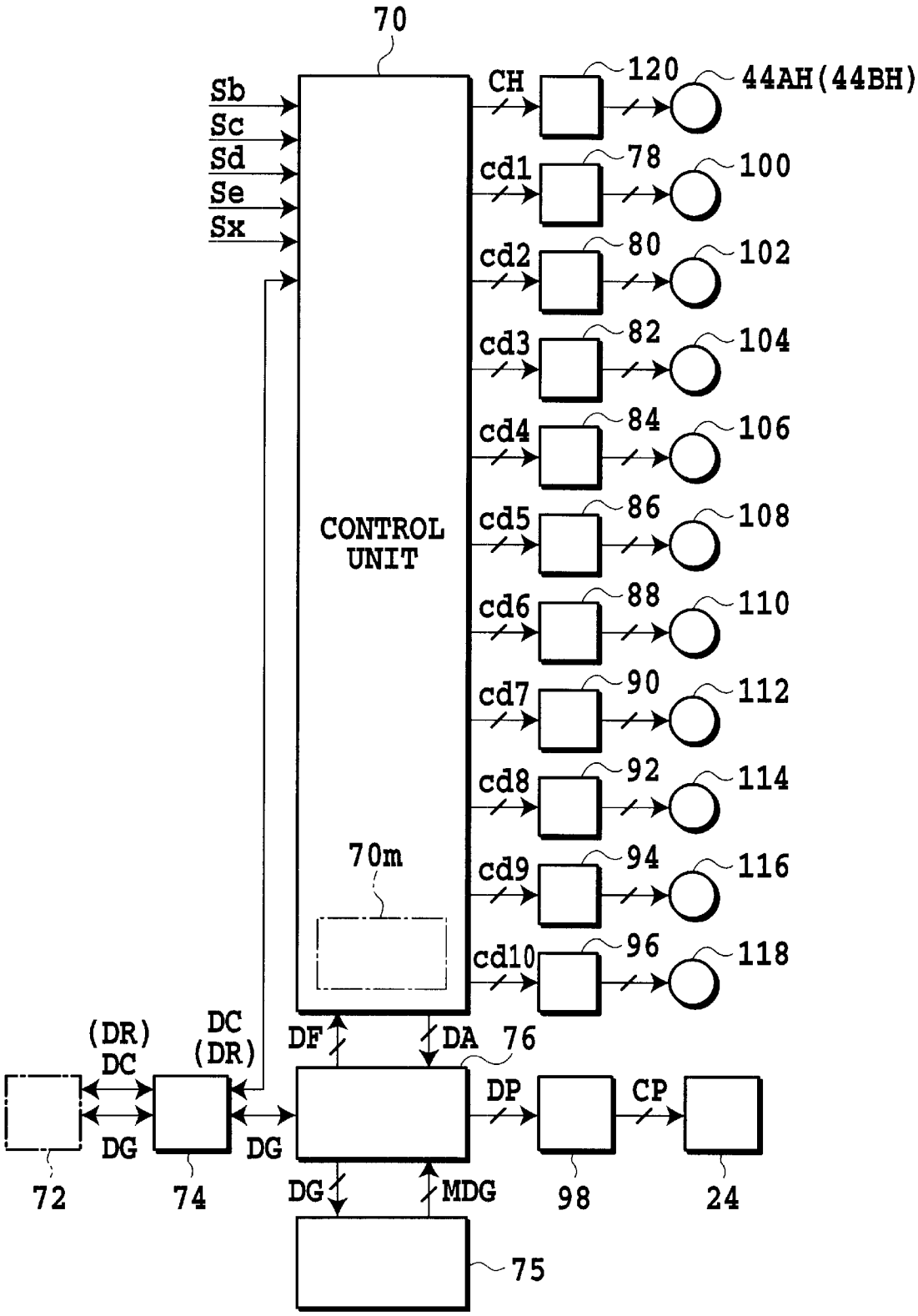
FIG. 21 is a block diagram showing the construction of a control block provided in the second embodiment of the image forming apparatus according to the present invention.

Further, also in the present example, as shown in FIG. 21, the control unit 70 is provided.

Figure 34:
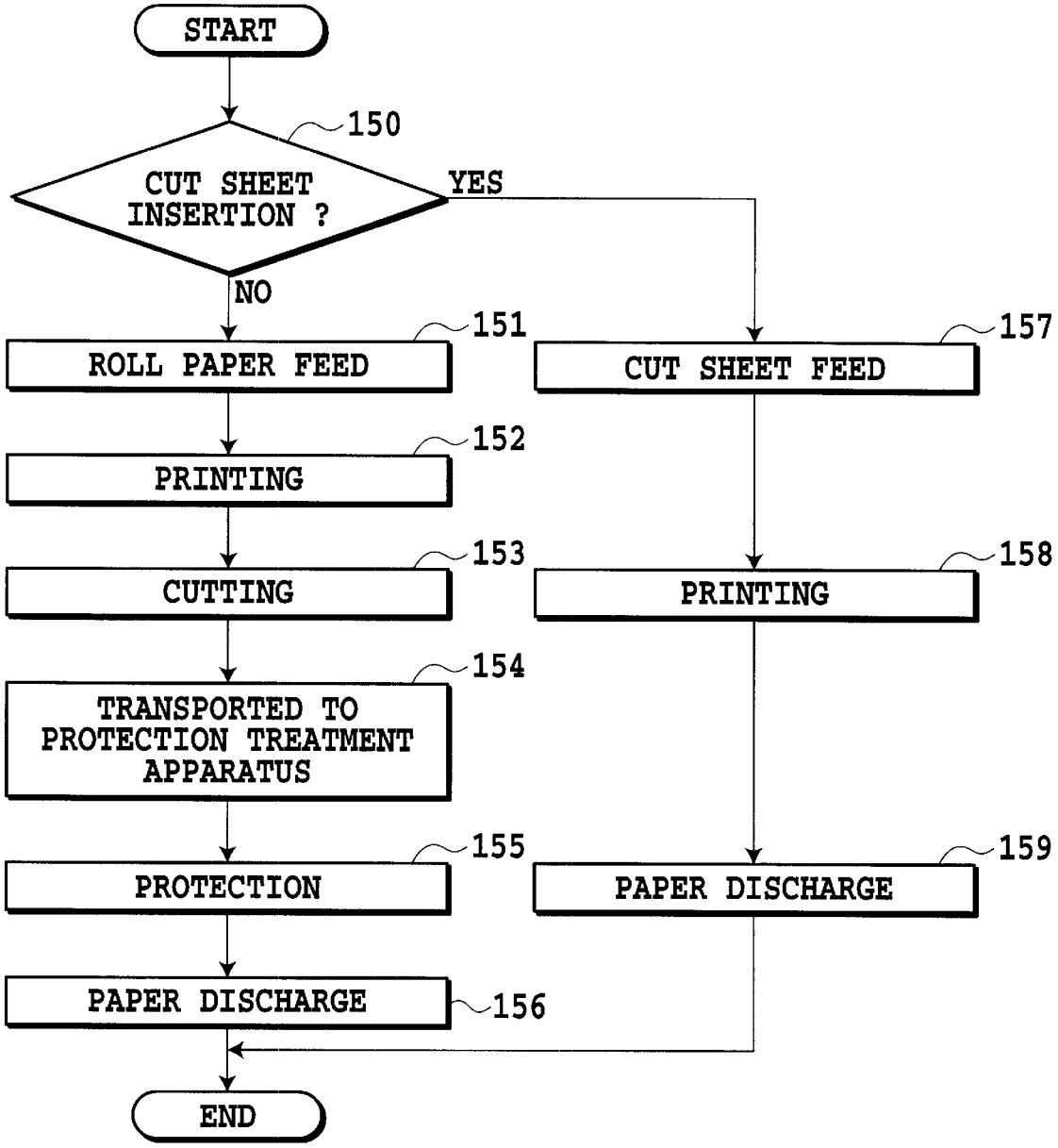
FIG. 34 is a diagram used for explaining a series of control processes in the second embodiment of the image forming apparatus according to the present invention.

The control unit 70, first, when it is determined that the paper Pac is not provided in the hand insertion passage 140 according to the detection output signal Se from the paper feed sensor 142 (step 150 in FIG. 34), as shown in FIG. 34), forms the control signal Cd1 to pull out the leading head of the roll paper Pa by the pulling rollers 14A and 14B, and supplies it to the drive circuit part 78. The drive circuit part 78 forms a drive control pulse signal according to the control signal Cd1 and supplies it to the drive motor 100.

Figure 22:
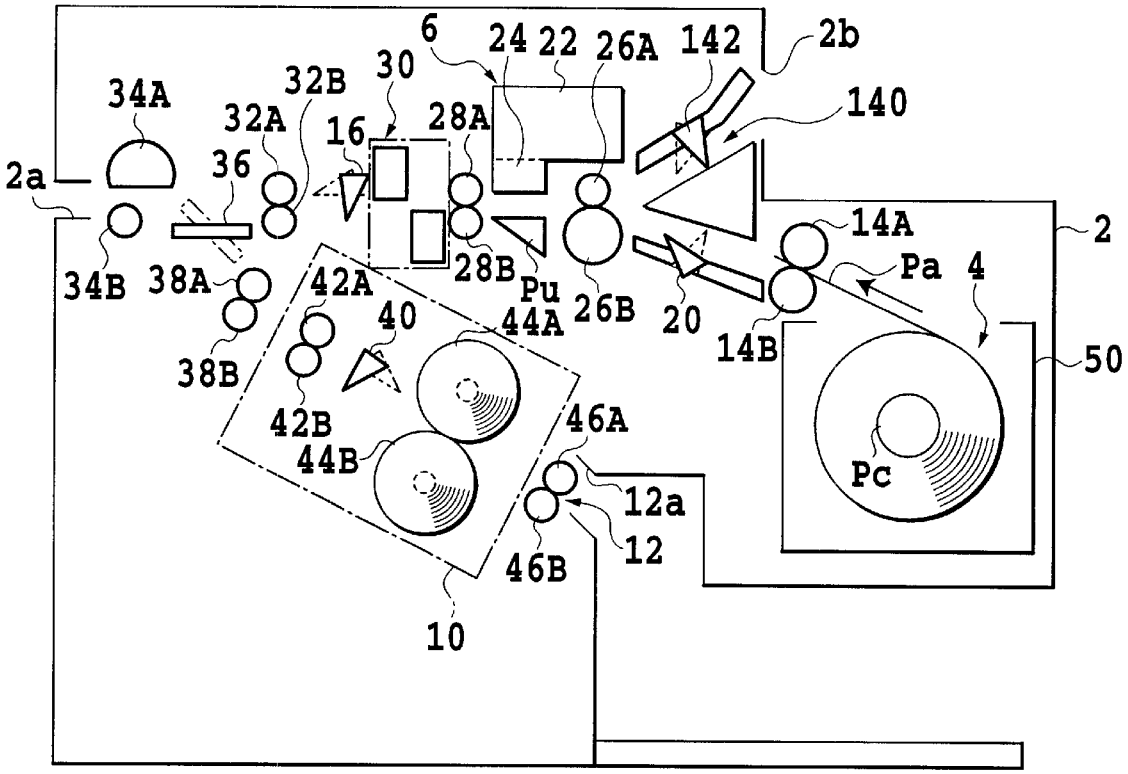
FIG. 22 is a diagram used for explaining operation of the second embodiment of the image forming apparatus according to the present invention.
Figure 23:
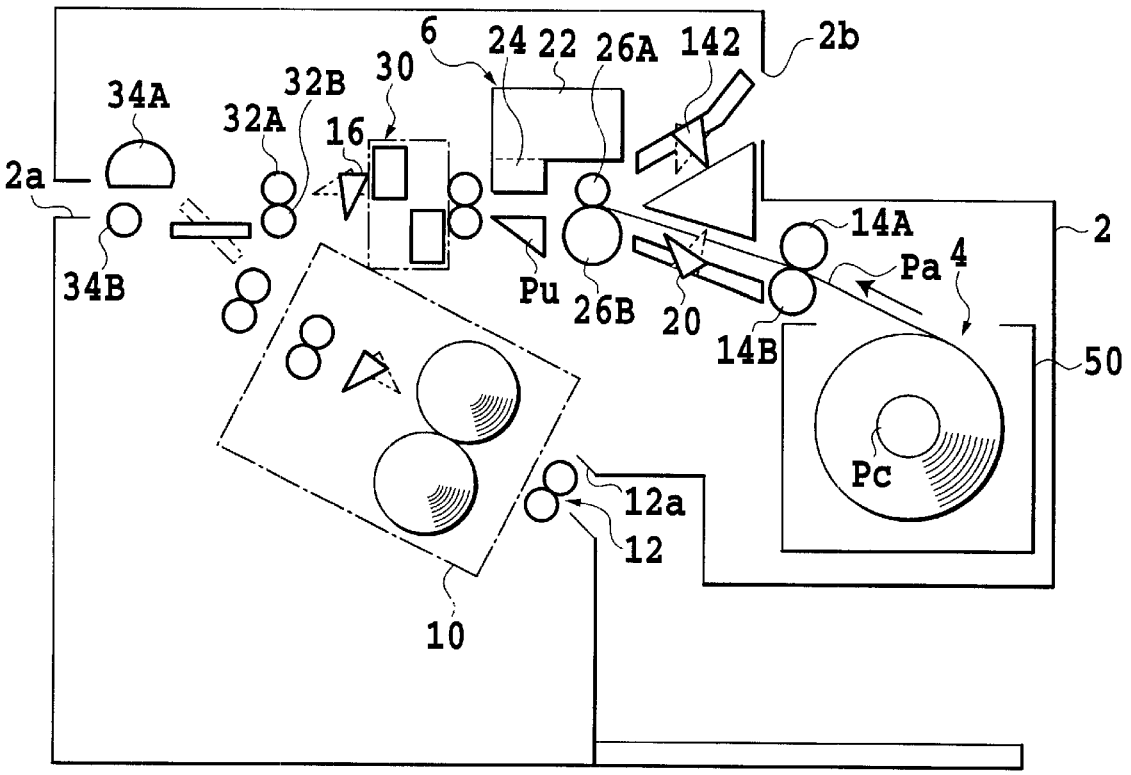
FIG. 23 is a diagram used for explaining operation of the second embodiment of the image forming apparatus according to the present invention.

Next, the control unit 70, as shown in FIG. 22 and FIG. 23, forms the control signal Cd2 to transport the roll paper Pa so that the recording surface of the roll paper Pa reaches a predetermined position beneath the print head 24, and supplies it to the drive circuit part 80. The drive circuit part 80 forms a drive control pulse signal according to the control signal Cd2, and supplies it to the drive motor 102. At this moment, the control unit 70 forms the control signal Cd3 to feed a predetermined length of the roll paper Pa according to the detection output signal Sb from the position sensor 20, and supplies it to the drive circuit part 82. By this operation, the transportation roller 26A and the pinch roller 26B are rotated by a predetermined number of turns so that the leading head of the roll paper Pa reaches a predetermined position beneath the print head 24. Thus, as shown in FIG. 34, paper feed of the roll paper Pa is performed (step 151).

Figure 24:
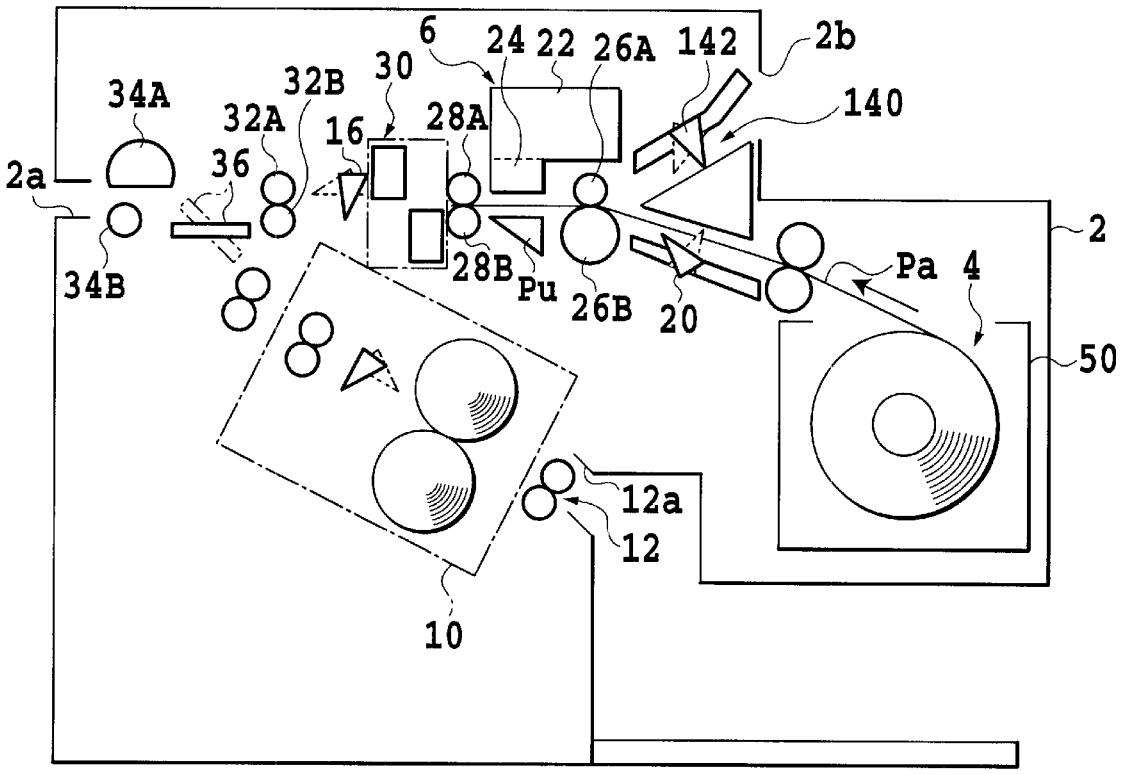
FIG. 24 is a diagram used for explaining operation of the second embodiment of the image forming apparatus according to the present invention.
Figure 25:
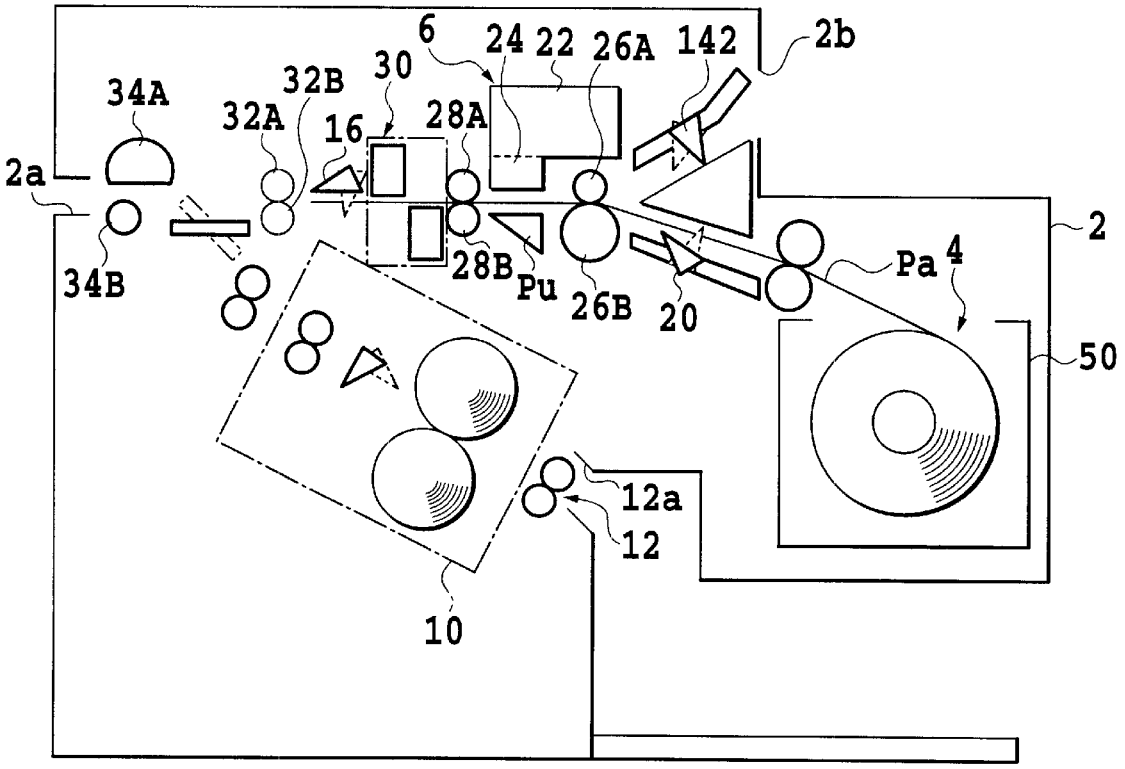
FIG. 25 is a diagram used for explaining operation of the second embodiment of the image forming apparatus according to the present invention.

Next, the control unit 70, as shown in FIGS. 24 and 25, supplies a control signal to the transportation control part (not shown) to cause the carriage member 22 to make reciprocal movement by a predetermined distance in the vertical direction to the paper surface, and forms the control signal Cd3 to intermittently transport every predetermined amount of the roll paper, and supplies it to the drive circuit part 82. Further, the control unit 70 supplies the control data DA to the image processing part 76. By this operation, image is successively formed on the recording surface of the transported roll paper Pa (step 152 in FIG. 34).

Figure 26:
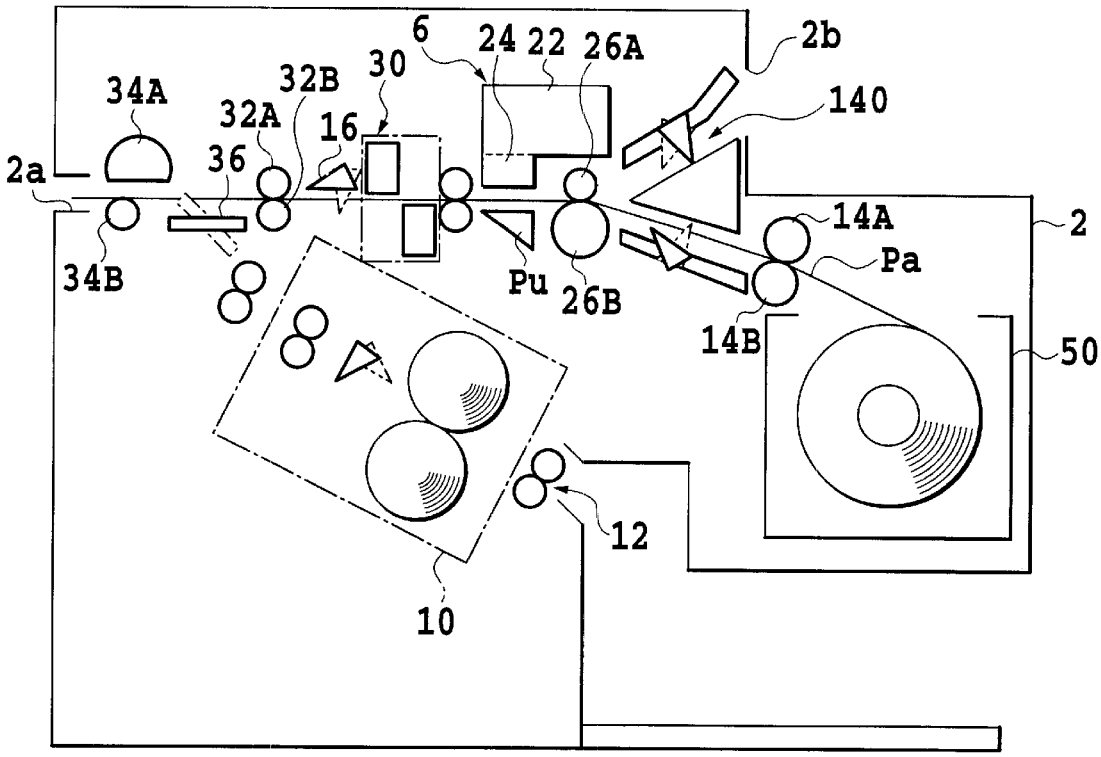
FIG. 26 is a diagram used for explaining operation of the second embodiment of the image forming apparatus according to the present invention.

Next, the control unit 70, as shown in FIG. 26, after the completion of printing operation, forms the control signal Cd3 to form a predetermined space in the boundary part with an unprinted part continued from the printed surface of the printed roll paper Pa so that the roll paper Pa stops at a predetermined position beneath the rotary cutter unit 30, and supplies it to the drive circuit part 82. At this moment, the control unit 70 forms the control signal Cd4 to operate the rotary cutter unit 30, and supplies it to the drive circuit 84. By this operation, a predetermined position on the recording surface of the roll paper Pa beneath the rotary cutter unit 30 is cut to obtain a sheet of printed paper Pac (step 153 in FIG. 34).

Figure 27:
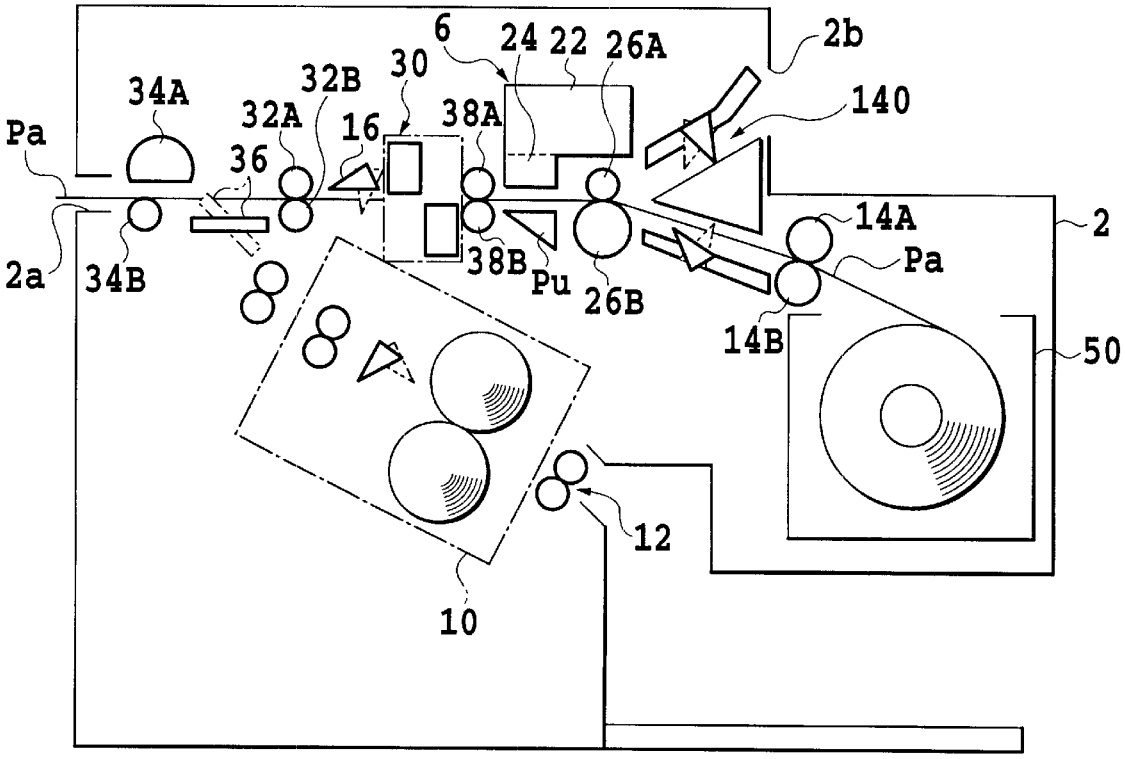
FIG. 27 is a diagram used for explaining operation of the second embodiment of the image forming apparatus according to the present invention.

The control unit 70, as shown in FIG. 27, supplies the control signal Cd1 to the drive circuit part 78 so that the cut part of the recording surface of the roll paper Pa is returned to a predetermined position beneath the print head 24. By this operation, as shown in FIG. 27, the cut part of the recording surface of the roll paper Pa is stopped at a predetermined printing start position.

Figure 28:
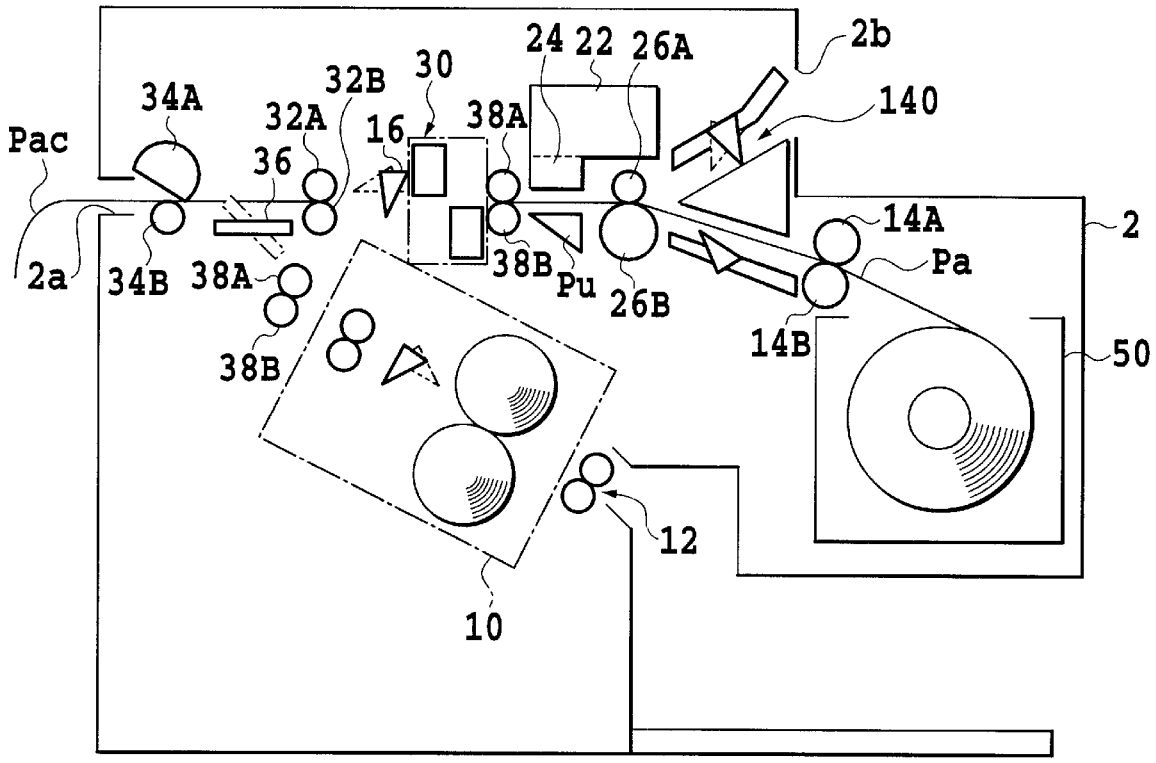
FIG. 28 is a diagram used for explaining operation of the second embodiment of the image forming apparatus according to the present invention.
Figure 30:
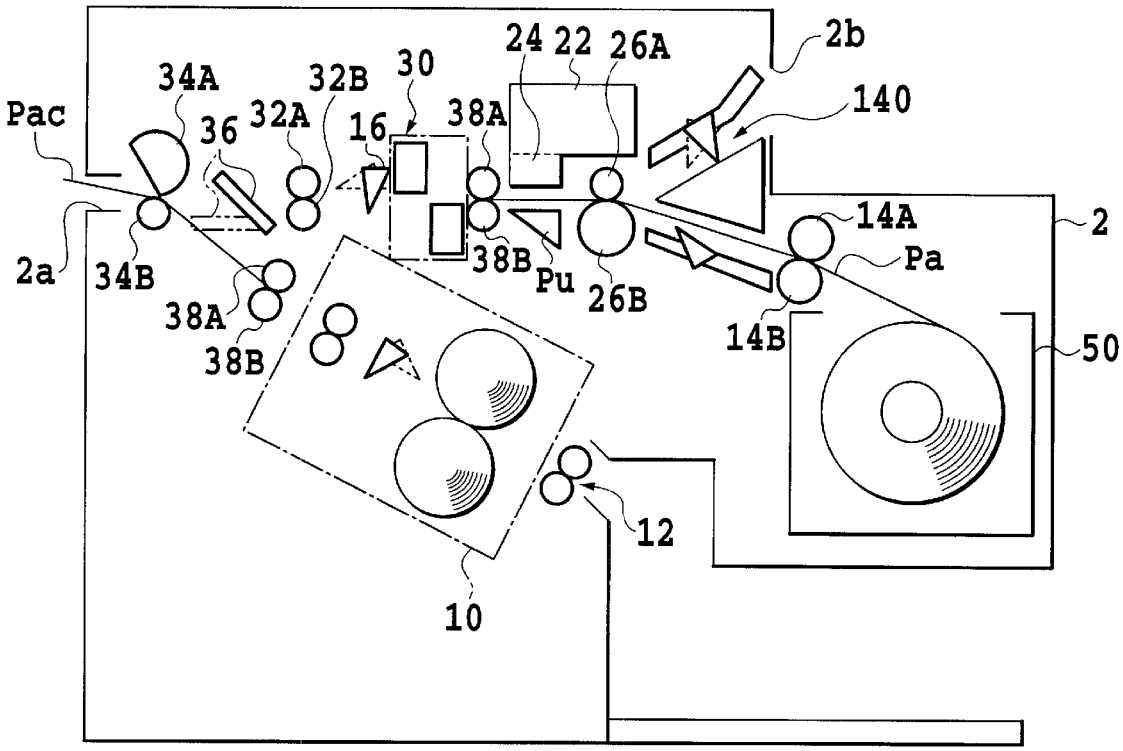
FIG. 30 is a diagram used for explaining operation of the second embodiment of the image forming apparatus according to the present invention.

Next, the control unit 70, as shown in FIGS. 28 and 30, supplies the control signal Cd5 to the drive circuit part 86 to further transport a predetermined length of the paper Pac, forms a control signal Cd6 to rotate the D cut roller 34A and the pinch roller 34B by about one turn, and supplies it to the drive circuit part 88. In this case, the guide member 36, as shown by the solid line in FIG. 28, is maintained to be parallel with the recording surface of the paper Pac. Further, a feeding direction end of the paper Pac is protruded to the outside through the opening 2*a*.

Figure 29:
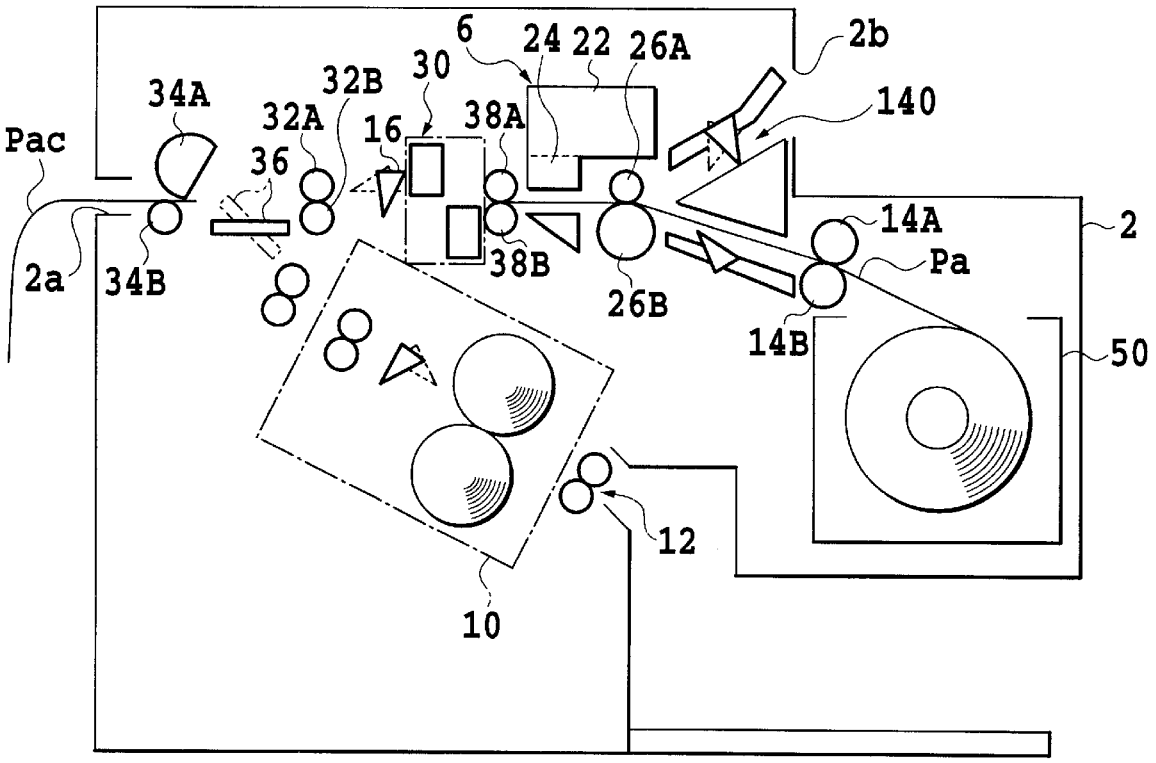
FIG. 29 is a diagram used for explaining operation of the second embodiment of the image forming apparatus according to the present invention.

Next, the control unit 70, when rotated by a predetermined angle until the D cut roller 34A and the pinch roller 34B become from the state shown in FIG. 28 to the state shown in FIG. 29, stops supply of the control signal Cd6. By this operation, a greater part of the paper Pac, as shown in FIG. 29, is exposed to the outside through the opening 2*a*.

Next, the control unit 70, as shown in FIG. 30, forms a control signal Cd7 to rotate the guide member 36 by a predetermined angle towards the right side diagonally beneath, and supplies it to a drive circuit part 90, forms the control signal Cd6 to rotate the D cut roller 34A from the state shown in FIG. 29 in a direction shown by the arrow R in FIGS. 29 and 30, and supplies it to the drive circuit 88. By this operation, the paper Pac is guided from its upstream end to the other surface of the guide member 36 to reach the transportation rollers 38A and 38B.

Figure 31:
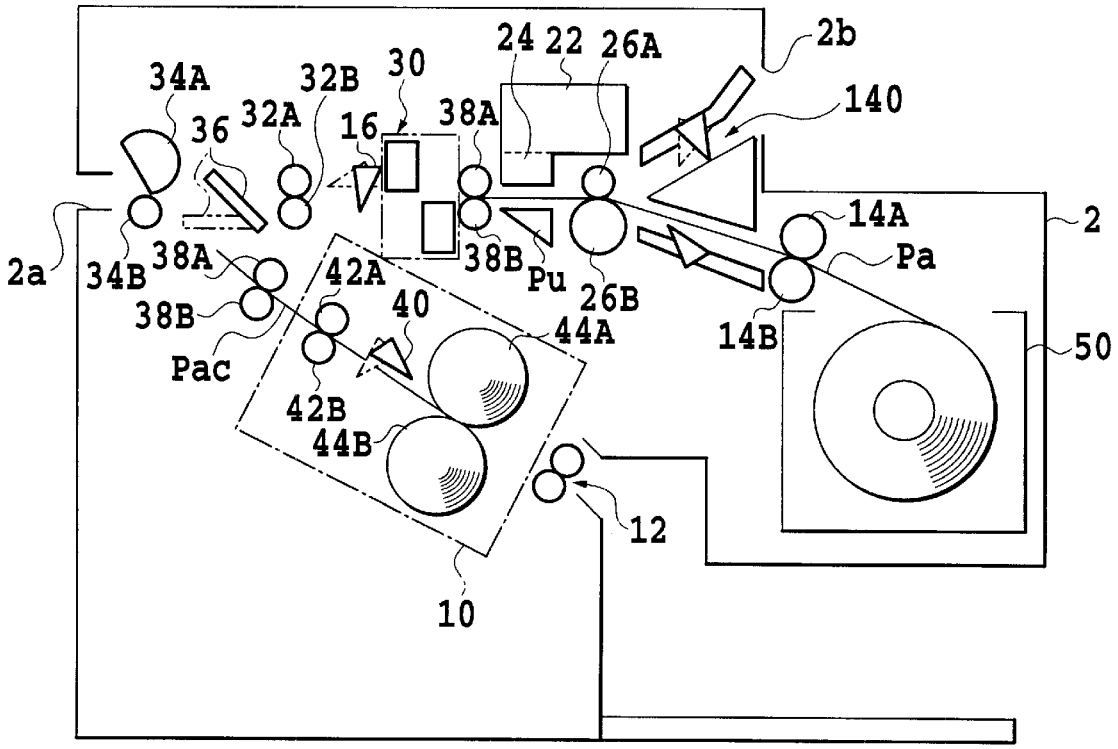
FIG. 31 is a diagram used for explaining operation of the second embodiment of the image forming apparatus according to the present invention.

Next, the control unit 70, as shown in FIG. 31, forms control signals Cd8 and Cd9, respectively, to supply the paper Pac into the protection treatment apparatus for protection treatment of the paper Pac, and supplies them to drive circuits 92 and 94 (step 154 in FIG. 34). Further, the control unit 70 forms the control signal CH according to the detection output signal Sx to maintain the heater 44AH and the heater 44BH at predetermined temperatures, and supplies it to the drive circuit 120.

Figure 32:
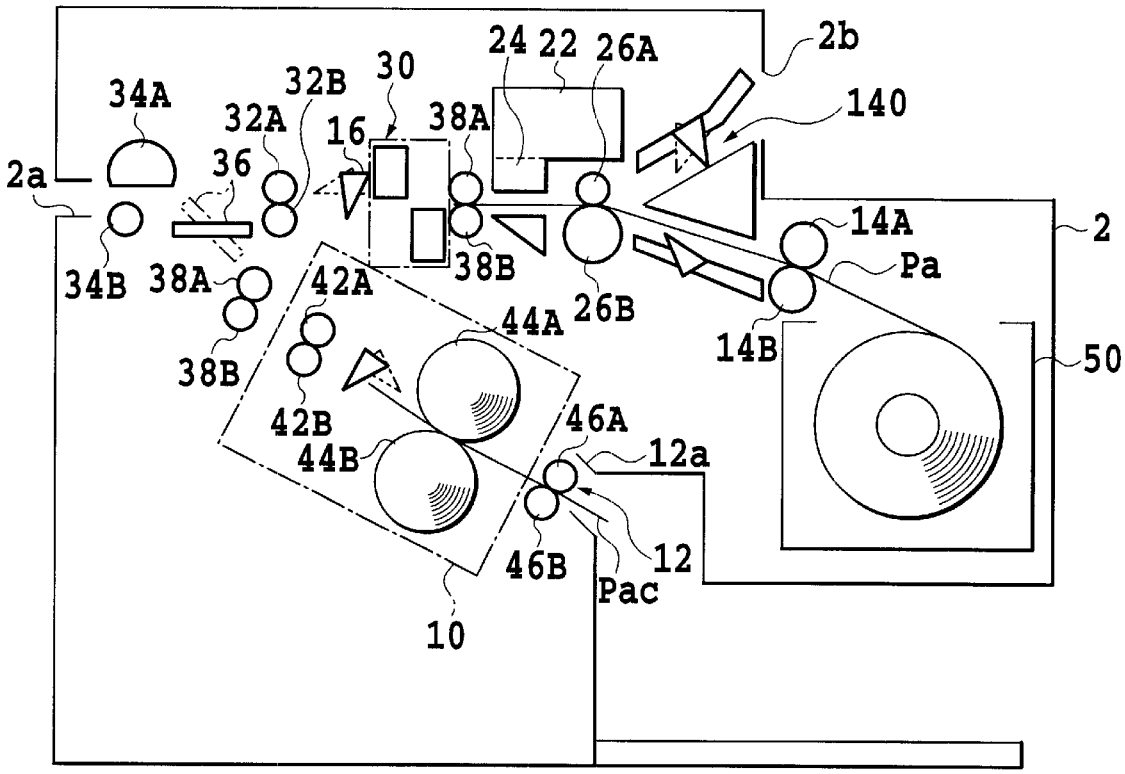
FIG. 32 is a diagram used for explaining operation of the second embodiment of the image forming apparatus according to the present invention.

By this operation, as shown in FIG. 32, the paper Pac is transported into the protection treatment apparatus 10, pinched by the protection treatment rollers 44A and 44B, and protection treatment to heat the paper Pac to a predetermined temperature is performed (step 155 in FIG. 34).

Figure 33:
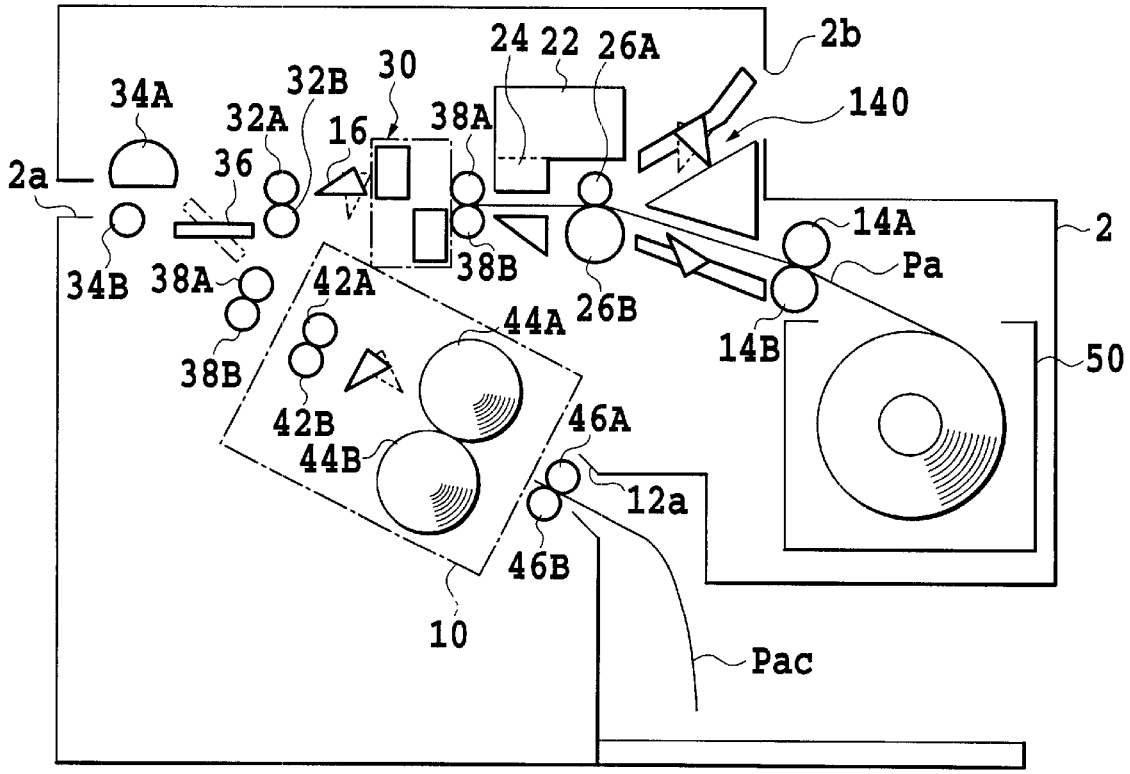
FIG. 33 is a diagram used for explaining operation of the second embodiment of the image forming apparatus according to the present invention.

Next, the control unit 70 forms the control signal Cd7 according to the detection output signal Sd as shown in FIG. 32 to return the guide member 36 from the position of the broken line along the transportation passage to a parallel angular position, and supplies the signal to the drive circuit 90, and forms a control signal Cd10 to discharge the paper Pac through the delivery part 12, and supplies it to the drive circuit part 96. The drive circuit part 96 supplies a drive control pulse signal to the drive motor 118 to make the drive motor 118 of the discharge rollers 46A and 46B operative. By this operation, as shown in FIG. 33, the protection treated paper Pac is discharged through the delivery part 12 (step 156 in FIG. 34).

Figure 35:
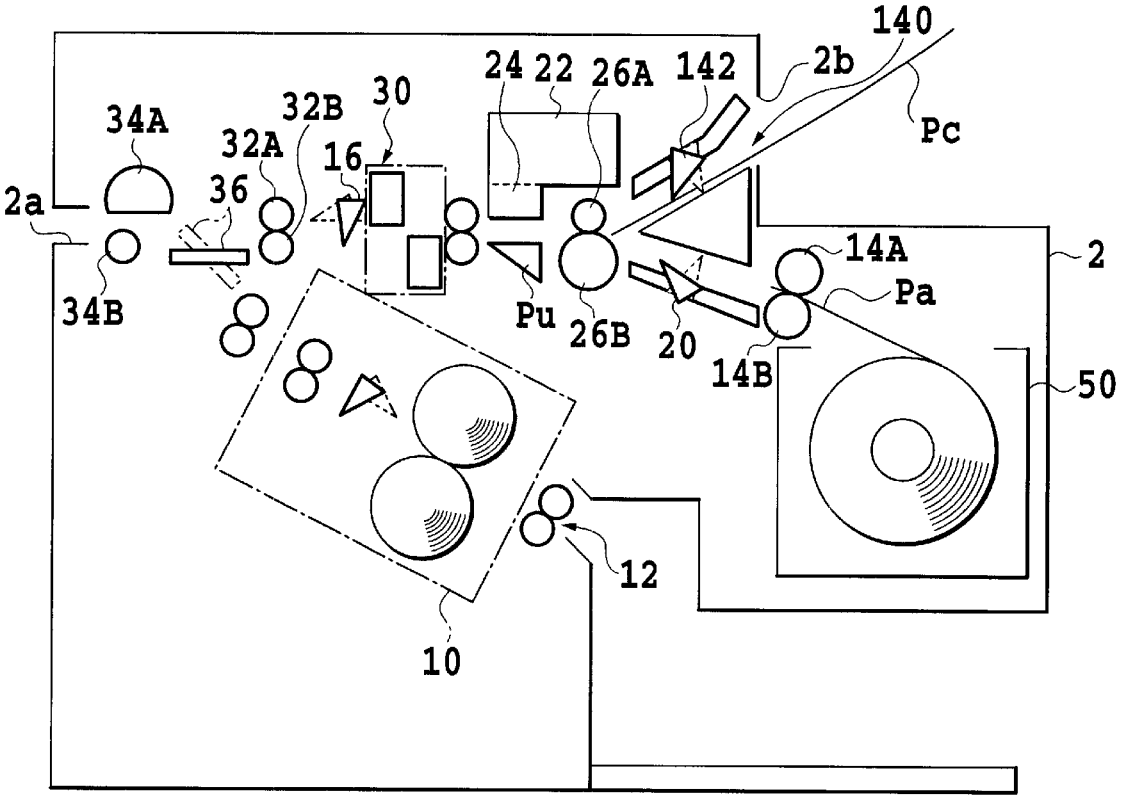
FIG. 35 is a diagram used for explaining operation of the second embodiment of the image forming apparatus according to the present invention.
Figure 36:
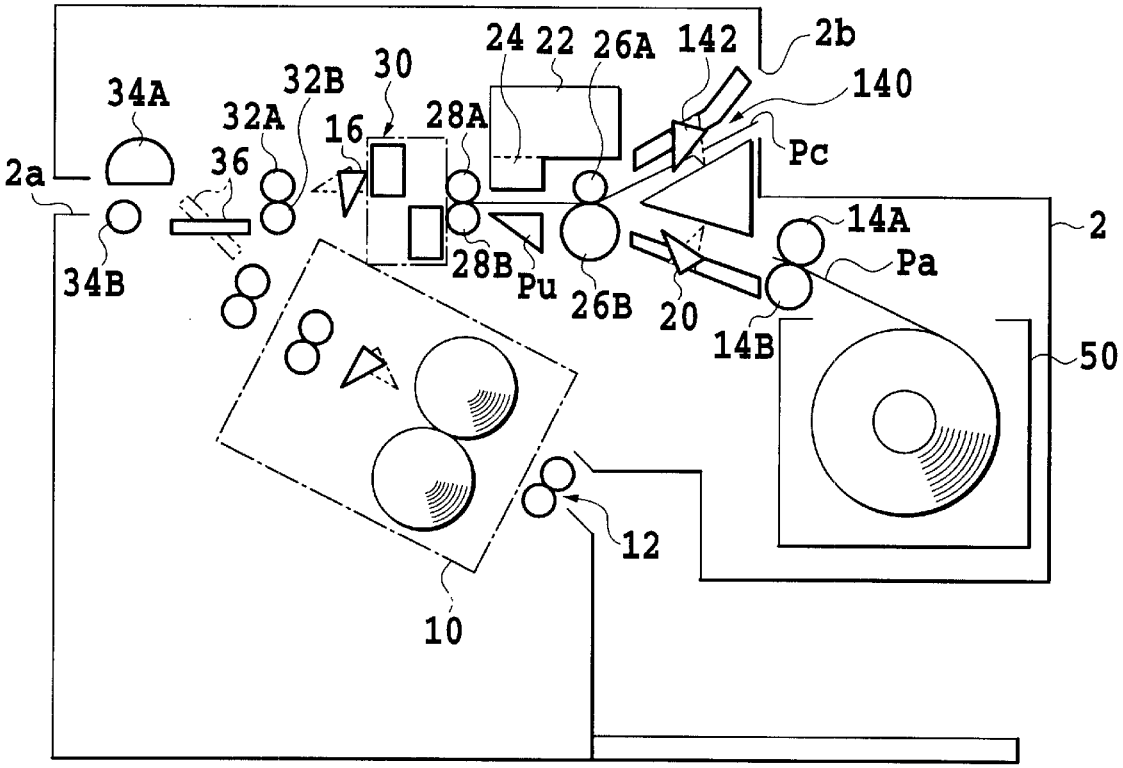
FIG. 36 is a diagram used for explaining operation of the second embodiment of the image forming apparatus according to the present invention.

On the other hand, the control unit 70, when it is determined according to the detection output signal Se from the paper feed sensor 142 that a paper Pc is inserted in the hand insertion passage 140 (step 150 in FIG. 34), first, as shown in FIG. 35 and FIG. 36, forms the control signal Cd3 to transport the paper Pc so that the recording surface of the paper Pc reaches a predetermined position beneath the print head 24, and supplies it to the drive circuit part 82. By this operation, the transportation roller 26A and the pinch roller 26B are rotated by a predetermined number of turns so that the leading head of the paper Pc reaches a predetermined position beneath the print head.

Figure 37:
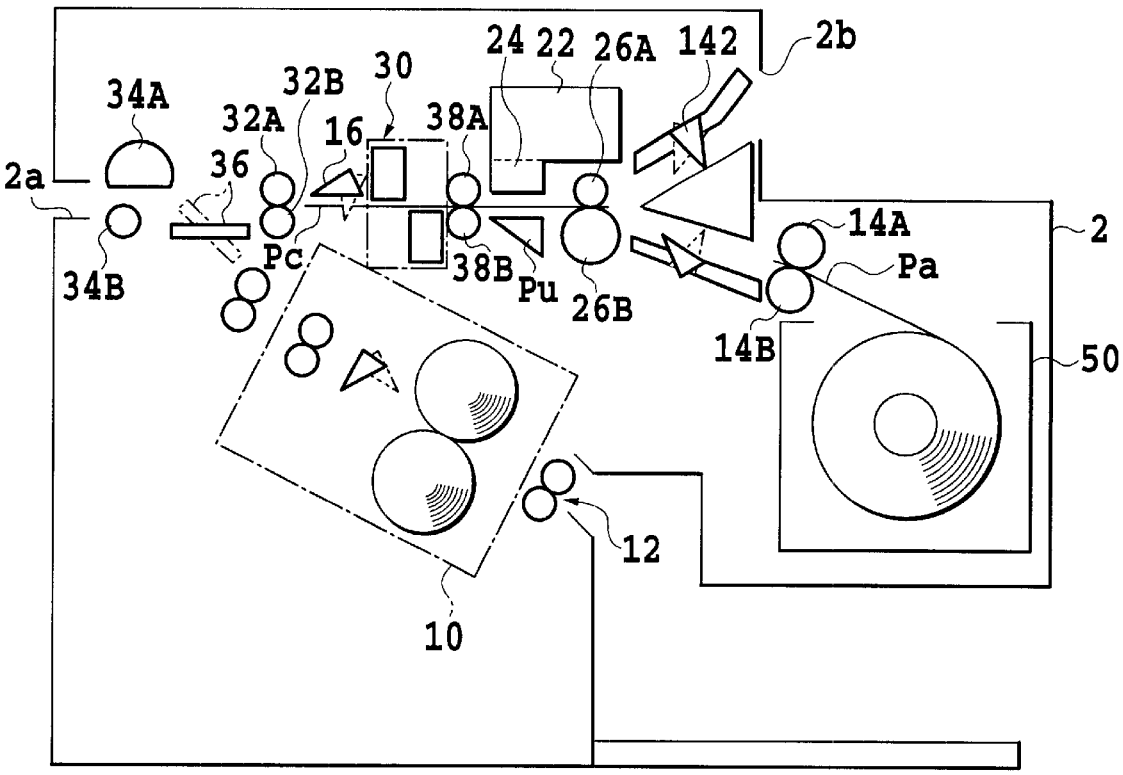
FIG. 37 is a diagram used for explaining operation of the second embodiment of the image forming apparatus according to the present invention.

Next, the control unit 70, as shown in above-described FIG. 37, supplies a control signal to a transportation control part (not shown) to reciprocally move the carriage member 22 in the vertical direction to the paper surface by a predetermined distance, forms the control signal Cd3 to intermittently transport the paper Pc by every predetermined length, and supplies it to the drive circuit part 82. Further, the control unit 70 supplies the control data DA to the image processing part 76. By this operation, the image is successively formed on the recording surface of the transported paper Pc (step 158 in FIG. 34).

Figure 38:
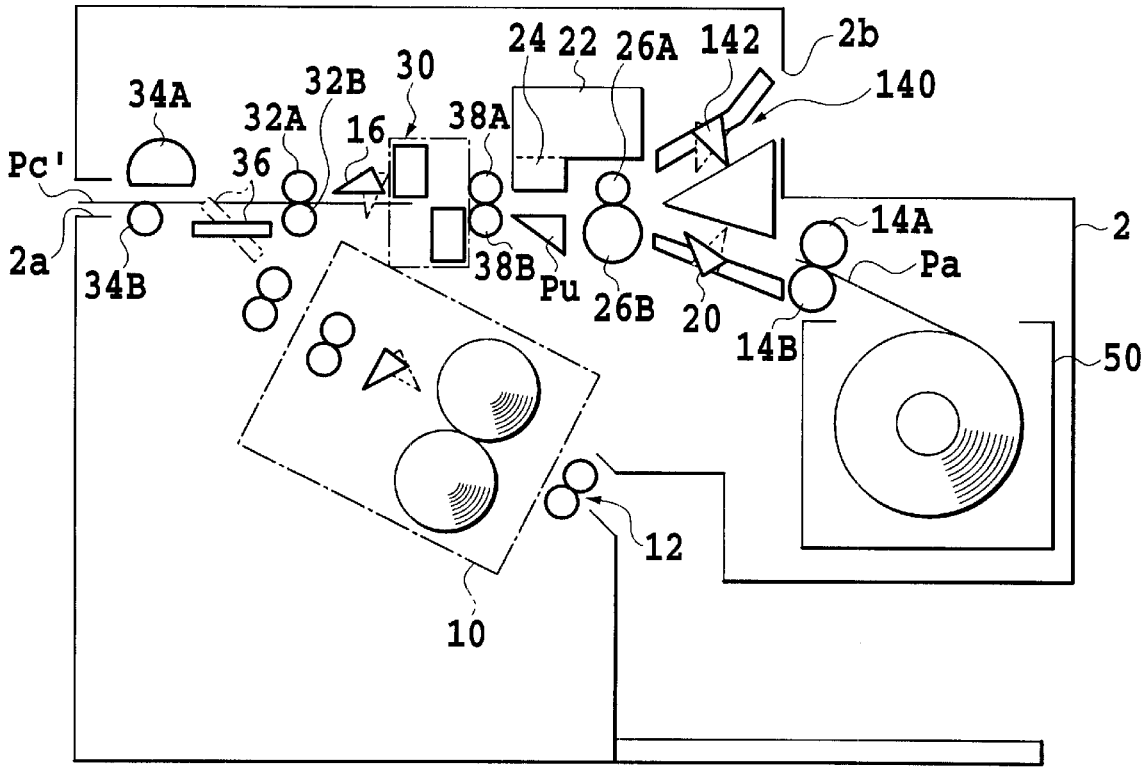
FIG. 38 is a diagram used for explaining operation of the second embodiment of the image forming apparatus according to the present invention.
Figure 39:
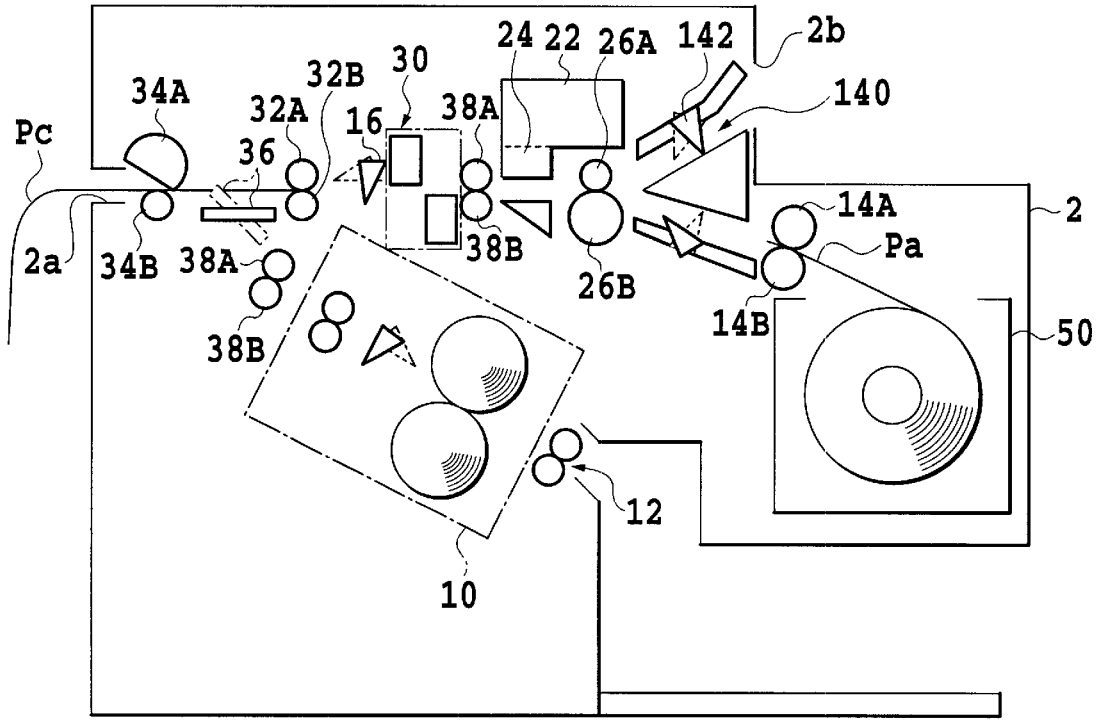
FIG. 39 is a diagram used for explaining operation of the second embodiment of the image forming apparatus according to the present invention.
Figure 40:
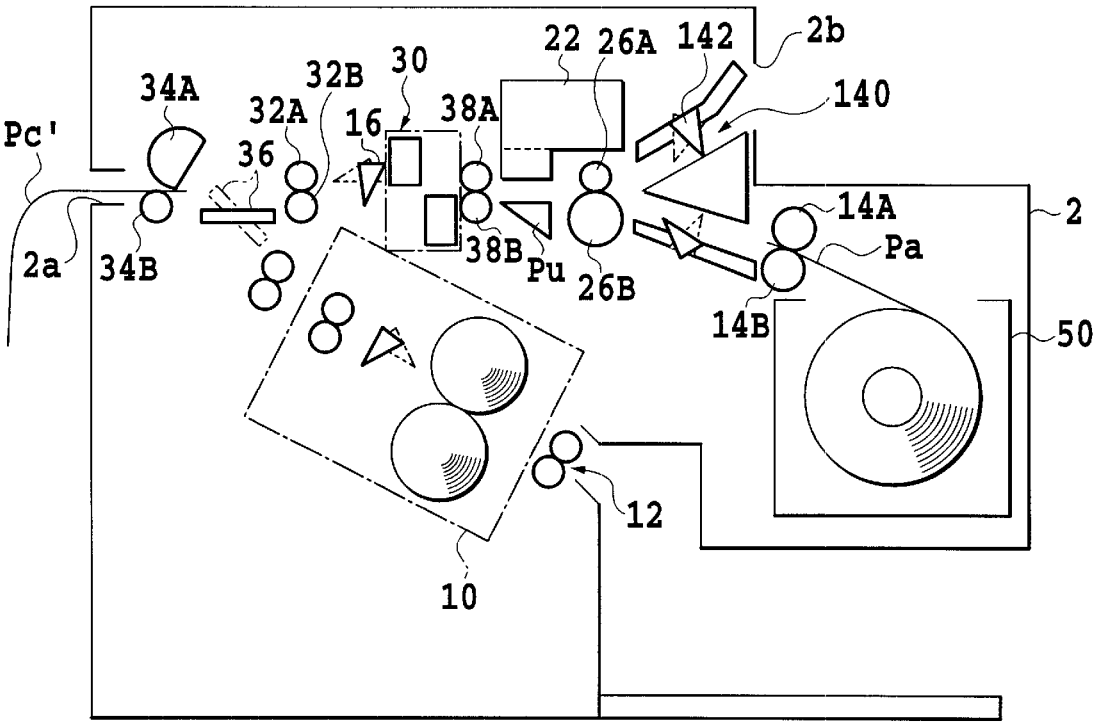
FIG. 40 is a diagram used for explaining operation of the second embodiment of the image forming apparatus according to the present invention.
Figure 41:
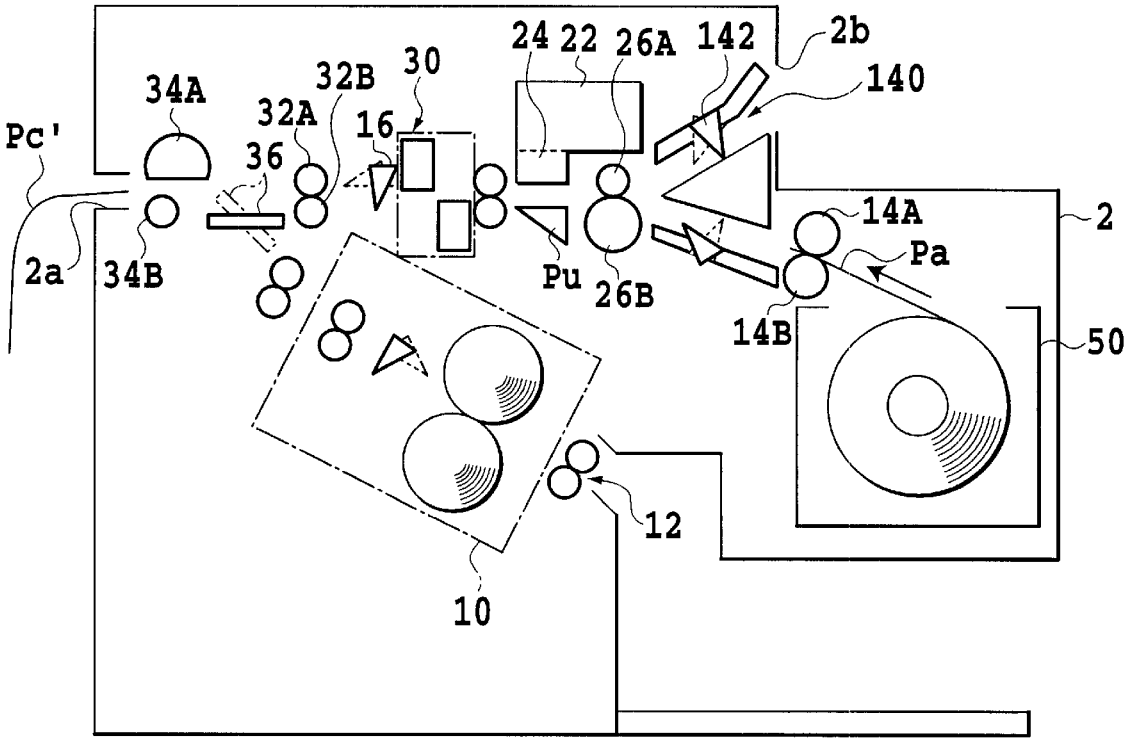
FIG. 41 is a diagram used for explaining operation of the second embodiment of the image forming apparatus according to the present invention.

Next, the control unit 70, supplies the control signal Cd5 to the drive circuit part 86 to further transport a predetermined length of the printed paper Pc', and forms the control signal Cd6 to rotate the D cut roller 34A and the pinch roller 34B by about one turn according to the detection output signal Sc, and supplies it to the drive circuit part 88. At this moment, the guide member 36, as shown by the solid line in FIG. 38, is maintained to be parallel to the recording surface of the paper Pc'. By this operation, as shown in FIGS. 39, 40 and 41, the paper Pc' is discharged to the outside from the feeding direction end through the opening 2*a* (step 159 in FIG. 34).

Therefore, by the above control, by passing the paper Pc not requiring protection treatment over the protection treatment apparatus 10, eventual unnecessary jamming and associated scorching, generation of smoke, and deteriorating damages such as scorching to the paper Pc' due to unnecessary heating can be avoided. Further, depending on the cases, possible disorders such as sticking of the paper Pc' to the protection treatment apparatus 10, and associated scorching, and smoke generation are prevented.

[Third Embodiment]

FIG. 42 schematically illustrates a third embodiment of the image forming apparatus according to the present invention, and FIGS. 43A, 43B and 43C respectively show partial cross sections of the printing medium and laminate members which will be described later used in the embodiment.

FIG. 42 schematicallly shows part of the apparatus to which the present invention is applied. The apparatus shown in FIG. 42 comprises an ink-jet printing part 201 for performing ink-jet printing to the ink receiving layer side recording surface of the roll paper wound into a roll RA, and a laminate treatment part 202 for forming a transparent film layer onto the recording surface of the roll paper 204 printed as will be described later.

In the ink-jet printing part 201, an ink-jet print head 203 mounted on an ink-jet print head mounting part (not shown), as shown in FIG. 43A, provides an ink drop to an ink receiving layer 204*a* formed on a base material 204*b* of the printing medium 204, thereby forming a predetermined image. The roll paper 204, after forming of the image, is cut to an appropriate size by a cutter 209 disposed between the ink-jet print head 203 and the laminate treatment part 202. The cut paper is supplied to the laminate treatment part 202.

The laminate treatment part 202 comprises a delivery apparatus 210 for successively supplying a wound laminate member 205 to the transportation passage in a direction shown by the arrow according to the transportation state of the roll paper 204, a winding apparatus 207 disposed at the downstream side opposing the delivery apparatus 210 for winding only the base material 204*b* of the laminate member 205 along a direction shown by the arrow, and a roller pair 206 for pressing the laminate member 205 placed against the ink receiving layer 204*a* of the printing medium 204. The laminate member 205, as shown in FIG. 43B, has a structure in which a transparent film forming layer 205*a* is laminated onto the base material 205*b*. The transparent film forming layer 205*a* is laminated to the base material 205*b* so as to be readily peeled off.

The ink receiving layer 204*a* of the cut and supplied cut paper, as shown in FIG. 43B, is laminated with the transparent film forming material layer 205*a* of the laminate member 205 from the delivery apparatus 210 successively from an end of the feeding direction side. The cut paper stacked with the laminate member 250 is transported in that state to the roller pair 206. By this operation, the cut paper stacked with the laminate member 205 is heated and applied with a pressure as necessary by the roller pair 206. Therefore, by pressing the transparent forming layer 205*a* against the ink receiving layer 204*a,* the transparent film layer 205*c* is press-contacted to the upper surface of the ink receiving layer 204*a*.

After the cut paper pressed with the transparent film layer on the upper surface of the ink receiving layer 204*a* is passed through the roller pair 206, only its base material 205*b* is peeled out from the cut paper by the winding apparatus 207. Therefore, as shown in FIG. 43C, a printed article 208 is obtained on which the ink receiving layer 204 receiving the image is protected by the transparent film layer 205*c*. The printed article 208 is transported towards the downstream side.

Also in the example shown in FIG. 42, image forming by the ink-jet method is possible to the printing medium such as a roll paper not requiring heat treatment and cut paper and the like. In such a case, the present invention described in the first embodiment and the second embodiment can be applied.

For example, it may be set so that the printing medium to be heat treated by the control of the above-described control unit 70 is subjected to predetermined heat treatment by passing the roller pair 206 and, on the other hand, printing medium not requiring heat treatment does not pass through the roller pair 206.

When not requiring heat treatment, after setting so that heat treatment by the roller pair 206 is not performed to the printing medium, that is, in the state that the roller pair 206 is not heated, the printing medium may be passed through the roller pair 206. By this operation, the same effect as obtained in the above first embodiment and the second embodiment can be obtained.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image forming apparatus comprising:

a common transportation passage through which sheets of a plurality of different types of printing media are transported; wherein a cartridge is detachably mounted to said image forming apparatus proximate to said common transportation passage and wherein the cartridge contains a type of printing medium and includes an identification part for representing the type of the printing medium contained within the cartridge;

a printing part disposed opposite to said common transportation passage for providing a print head for performing a printing operation on a recording surface of the printing medium;

a protection treatment apparatus for performing protection treatment on the printing medium for protection of an image on the recording surface printed by said printing part;

a protection treatment transportation passage connected to said common transportation passage for transporting the printing medium to said protection treatment apparatus to be subjected to the protection treatment;

a discharge passage connected to said common transportation passage for discharging the printing medium printed by said printing part without passing through said protection treatment apparatus;

a selective delivery part provided upstream of said discharge passage, said protection treatment transportation passage and said protection treatment apparatus delivering the printing medium printed by said printing part from said common transportation passage selectively to one of said protection treatment transportation passage and said discharge passage;

a printing medium detection part for detecting a type of the printing medium to reach said selective delivery part by detecting the identification part of the cartridge; and a control part for causing said selective delivery part to deliver the printing medium, printed by said printing part selectively to one of said protection treatment transportation passage and said discharge passage according to a detection output signal based on a detection of the identification part of the cartridge from said printing medium detection part.

2. The image forming apparatus as claimed in claim 1, wherein the identification part includes an identification pin, and said printing medium detection part includes a detection part for detecting the identification pin.

3. The image forming apparatus as claimed in claim 1, wherein said identification part provided on the cartridge includes a memory for storing data representing the type of the printing medium contained in the cartridge, and said printing medium detection part includes a data transmission circuit part for transmitting data read from the memory to said control part.

4. The image forming apparatus as claimed in claim 1, wherein said protection treatment apparatus effects heating treatment under pressure to a recording surface of the printing medium.

5. The image forming apparatus as claimed in claim 1, wherein the protection treatment is a process of heating and applying pressure to a protective layer formed on a surface of the printing medium, thereby changing the protective layer to a transparent film.

6. The image forming apparatus as claimed in claim 1, wherein said common transportation passage allows a printing medium supplied from a portion other than said mounting portion to be transported.

7. The image forming apparatus as claimed in claim 1, wherein said printing head is an ink-jet printing head for ejecting ink through an ink ejection opening.

* * * * *

UNITED STATES PATENT AND TRADEMARK OFFICE

CERTIFICATE OF CORRECTION

PATENT NO. : 6,533,478 B1
DATED : March 18, 2003
INVENTOR(S) : Shinichi Matsuyama It is certified that error appears in the above-identified patent and that said Letters Patent is hereby corrected as shown below:

Column 2,
Line 21, “surf ace” should read -- surface --.

Column 6,
Line 33, “detachable” should read -- detachable from --.

Column 12,
Line 7, “a” should read -- as --.

Column 13,
Line 8, “smokes,” should read -- smoke, --.
Line 61, “is possible” should read -- makes it possible --.
Line 66, after “to the above” should read -- is disposed above --.

Signed and Sealed this

Sixteenth Day of December, 2003

JAMES E. ROGAN
*Director of the United States Patent and Trademark Office*